US005725990A

United States Patent [19]

Hirai et al.

[11] Patent Number: 5,725,990

[45] Date of Patent: Mar. 10, 1998

[54] IMAGE FORMATION METHOD

[75] Inventors: Hiroyuki Hirai; Yoshiharu Yabuki, both of Kanagawa, Japan

[73] Assignee: Fuji Photo Film Co., Ltd., Kanagawa, Japan

[21] Appl. No.: 683,203

[22] Filed: Jul. 18, 1996

[30] Foreign Application Priority Data

Jul. 19, 1995 [JP] Japan ..... 7-204024

[51] Int. Cl.[6] ..... G03C 8/10; G03C 8/40; G03C 1/83; G03C 5/29

[52] U.S. Cl. ..... 430/203; 430/206; 430/220; 430/221; 430/351; 430/353; 430/404; 430/317; 430/517; 430/520; 430/521; 430/617

[58] Field of Search ..... 420/203, 206, 420/220, 221, 404, 517, 520, 521, 617, 351, 353

[56] References Cited

U.S. PATENT DOCUMENTS 3,769,019 10/1973 Wiese et al. ..... 430/203
4,740,445 4/1988 Hirai et al. ..... 430/203
4,876,171 10/1989 Hitai ..... 430/203
4,880,423 11/1989 Hirai et al. ..... 430/203
4,880,730 11/1989 Sato et al. ..... 430/520
5,547,810 8/1996 Morimoto et al. ..... 430/203

*Primary Examiner*—Richard L. Schilling
*Attorney, Agent, or Firm*—Sughrue, Mion, Zinn, Macpeak & Seas, PLLC

[57] ABSTRACT

An image formation method comprising imagewise exposing a silver halide light-sensitive material comprising a support having thereon a light-sensitive silver halide, a binder, a slightly water soluble basic metal compound, and a dye composition which is decolorized or discolored on heat development; contacting the surface of the light-sensitive material with a sheet coated with a binder and a compound which forms a complex with a metal ion constituting the basic metal compound and heating them in the presence of a reducing agent and water after or during the imagewise exposing; and peeling off the sheet to obtain an image on at least the light-sensitive material and the sheet, wherein the dye composition comprises an oil-soluble dye formed by a leuco dye and a color developer.

3 Claims, No Drawings

IMAGE FORMATION METHOD

FIELD OF THE INVENTION

The present invention relates to an image formation method providing easily an image which is high in sensitivity and excellent in sharpness for a short period of time. Particularly, the present invention relates to an image formation method using a heat developable light-sensitive material having a colored layer comprising a dye composition which is rapidly decolorizable without elution and removal from a silver halide light-sensitive material.

BACKGROUND OF THE INVENTION

The heat developable light-sensitive materials are known in the art, and the heat developable light-sensitive materials and processes thereof are described in, for example, *Shashin Kohgaku no Kiso* (*Higinen Shashin*) (The Fundamentals of Photographic Engineering (Nonsilver Photograph)), pp.242–255 (1982), Corona Publishing Co. Ltd., and U.S. Pat. No. 4,500,626.

At present, image information is largely shifted from color images to color images because of a great deal of information and easy expressions. However, black-and-white images are still preferably used in specific fields such as the medical field. Also, in the print field, character information is usually used as black-and-white images.

These heat developable black-and-white light-sensitive materials are described in, for example, JP-B-43-4921 (the term "JP-B" as used herein means an "examined Japanese patent publication") and JP-B-43-4924, and commercial products thereof typically include "Dry Silver" supplied from Minnesota Mining and Manufacturing Co. The light-sensitive materials comprise silver halides, organic silver salts and reducing agents. In this system, unused silver halides and organic silver salts remain in the light-sensitive materials. The light-sensitive materials have therefore the disadvantage that the residual silver halides and organic silver salts are allowed to react to cause coloration of white grounds when they are exposed to strong light or stored for a long period of time.

Furthermore, a method for obtaining black color images by dry processing is described in U.S. Pat. Nos. 3,531,286 and 4,021,240, and *Research Disclosure* (hereinafter referred to as "RD"), No. 17326, pp.49–51 (September 1978). However, this system also has the same disadvantage as described above because of the unfixing type containing silver and silver salts in color images.

In order to overcome this disadvantage, methods for forming color images are proposed in which, after movable (diffusible) dyes are formed or released in the image-like form by heating, the movable dyes are transferred to dye fixing materials containing dye acceptable materials such as mordants and heat-resistant organic polymers by use of various transfer solvents, thereby improving keeping quality (e.g., JP-A-59-165054, U.S. Pat. Nos. 4,500,626 and 4,550,920)

However, in these methods, transfer is conducted after heat development, so that the number of steps is increased and the processing time is prolonged.

As a method for overcoming this disadvantage, a color image formation method has been proposed which comprises allowing a light-sensitive material to contain a slightly water-soluble basic metal compound, allowing a dye fixing material to contain a complex forming compound to a metal ion constituting the basic metal compound, and superimposing film surfaces of both the materials on each other, followed by heating, in the presence of water, thereby conducting development and dye transfer at the same time to obtain a color image on the light-sensitive material and/or the sheet (e.g., JP-A-62-129848 (the term "JP-A" as used herein means an "unexamined published Japanese patent application"), EP-A-210660, Japanese Patent Application No. 6-259805).

On the other hand, methods for forming silver images by the heat development silver salt diffusion transfer methods using silver halide light-sensitive materials are described in, e.g., JP-A-62-283332, JP-A-63-198050, Japanese Patent Application No. 6-325350.

In silver halide light-sensitive materials, silver halide emulsion layers and other hydrophilic colloidal layers are often colored for absorbing light having a particular wavelength.

When it is necessary to control a spectral component of light to be incident on the silver halide emulsion layer, a colored layer is usually formed on a side farther from a support than the silver halide emulsion layer. Such a colored layer is called a filter layer. When the plural silver halide emulsion layers are used, the filter layer is occasionally positioned therebetween.

For prevention of a blur of an image, namely halation, based on that light diffused in passing through the silver halide emulsion layer or after passage is reflected from an interface of the emulsion layer and a support or from a surface of the light-sensitive material opposite to the emulsion layer, and is incident again on the silver halide emulsion layer, a colored layer referred to as an antihalation layer is provided. When the plural silver halide emulsion layers are used, the antihalation layer is occasionally positioned therebetween.

In order to prevent a reduction in image sharpness based on light diffusion in the silver halide emulsion layer (this phenomenon is generally called irradiation), the silver halide layer is also colored.

In particular, when the colored layer is the filter layer or the antihalation layer disposed on the same side as that of the silver halide emulsion layer on the support, it is often necessary that the layer is selectively colored and that the other layers are not substantially colored, because if not so, not only the harmful spectral effect is exerted on the other layers, but also the effect as the filter layer or the antihalation layer is diminished. Also in the case of antihalation, selective dying of only the intended emulsion layer is required to exert no similar adverse effect on the other layers and to fully exhibit desired functions. The hydrophilic colloidal layer to be colored usually contains a dye. It is therefore necessary for the dye to satisfy the following requirements (1)–(5):

(1) It has suitable spectral absorption according to the purpose of use.

(2) It is photochemically inactive. Namely, an adverse effect in the chemical sense such as a reduction in sensitivity, regression of a latent image or fog is not given to the performance of the silver halide emulsion layer.

(3) It is decolorized during development processing, and leaves no harmful coloration on the light-sensitive material after processing.

(4) It does not diffuse from the colored layer to the other layers.

(5) It is excellent in raw storability in the light-sensitive material, and is not changed or not faded in color.

In the heat development light-sensitive material in which development processing is conducted by generating a base from the slightly water-soluble basic metal compound and the complex forming compound, a small amount of water is supplied to the light-sensitive material side before development, followed by heat development processing. It is therefore required that the dye be not eluted in water to contaminate processing water and is rapidly decolorized on heat development.

As a means for solving this problem, a method of dying a specified layer by use of a water-insoluble solid dye is disclosed in Japanese Patent Application No. 6-259805. However, when this method is used, inhibition of diffusion of the dye from the dye-fixed layer to the other layers or processing water, and decolorization on heat development processing are insufficient. Accordingly, further improvements have been desired.

On the other hand, JP-A-1-150132 discloses a silver halide light-sensitive material containing a leuco dye whose color has previously been developed with a metal salt of an organic acid. In this invention, metal ions are removed from a color-developed product of the leuco dye with various chelating agents (complex forming compounds) contained in a photographic processing solution, resulting in decolorization or discoloration. This invention only discloses that the leuco dye whose color has previously been developed with the metal salt of the organic acid is decolorized by wet processing for a relatively long period of time in which the chelating agents exist in large amounts. Accordingly, its effectiveness cannot be anticipated with respect to a heat development light-sensitive material in which a limited amount of complex forming compound is incorporated.

SUMMARY OF THE INVENTION

An object of the present invention relates to an image formation method providing easily an image which is high in sensitivity and excellent in sharpness for a short period of time.

Another object of the present invention relates to an image formation method using a dye composition not eluted in a small amount of water employed in development processing and not causing adverse effects such as image contamination even when the water is repeatedly used.

These and other objects of the present invention have been attained by an image formation method comprising imagewise exposing a silver halide light-sensitive material comprising a support having thereon a light-sensitive silver halide, a binder, a slightly water soluble basic metal compound, and a dye composition which is decolorized or discolored on heat development; contacting the surface of the light-sensitive material with a sheet coated with a binder and a compound which forms a complex with a metal ion constituting the basic metal compound and heating them in the presence of a reducing agent and water after or during the imagewise exposing; and peeling off the sheet to obtain an image on at least one of the light-sensitive material and the sheet, wherein the dye composition comprises an oil-soluble dye formed by a leuco dye and a color developer.

DETAILED DESCRIPTION OF THE INVENTION

In the above image formation method, the color developer is preferably a metal salt of an organic acid.

Preferably, the sheet further comprises a solvent for the sliver halide and a physical development nucleus.

More preferably, the silver halide light-sensitive material more preferably further comprises a dye-donating compound which forms a dye with an oxidant of the reducing agent by a coupling reaction.

The term "sheet" as used in the present invention also include a roll-shaped sheet.

The leuco dye for use in the light-sensitive material of the present invention is a compound whose color is generally developed in contact with a color developer, and is decolorized by the action of a base and/or heat, or by the action with a base and/or a complexing agent when the color developer is a metal salt of organic acid. The leuco dye is therefore introduced into the light-sensitive material in the form that the dye is in contact with the color developer, and can be decolorized by allowing the base and/or the complexing agent to act thereon when the light-sensitive material is processed. There is no particular limitation on the leuco dye for use in the present invention, and known leuco dyes can be used. The known leuco dyes are described in Moriga and Yoshida, *Senryo to Yakuhin* (*Dyes and Agents*), 9:84, Kaseihin Kogyo Kyokai (1964); *Shinpan Senryo Binran* (*New Dye Handbook*), p.242, Maruzen (1970); R. Garner, *Reports on the Progress of Appl. Chem.*, 56:199 (1971); *Senryo to Yakuhin* (*Dyes and Agents*), 19:230, Kaseihin Kogyo Kyokai (1974); *Shikizai* (*Coloring Materials*), 62:288 (1989); *Senshoku Kogyo* (*Dying Industry*), 32:208. The leuco dyes can be structurally classified into several series. Preferable examples thereof include diarylphthalide, fluoran, indolylphthalide, acylleucoazine, leucoauramine, spiropyran, rhodanine lactam, triarylmethane and chromene series. Typical examples are shown below:

(1) Diarylphthalides:

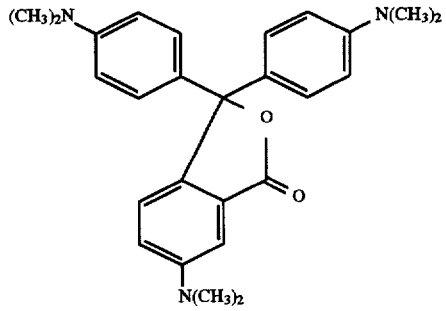

(1)

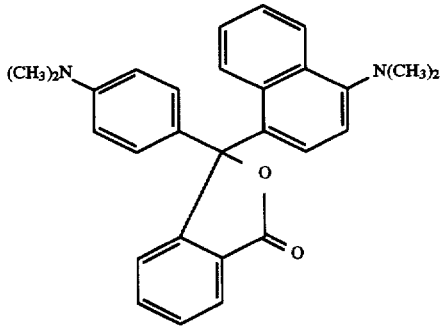

(2)

-continued
(3)
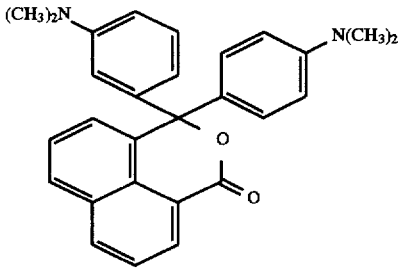
(4)
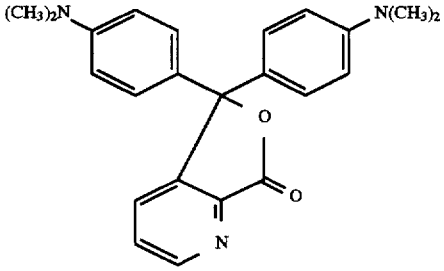
(2) Fluorans:
(5)
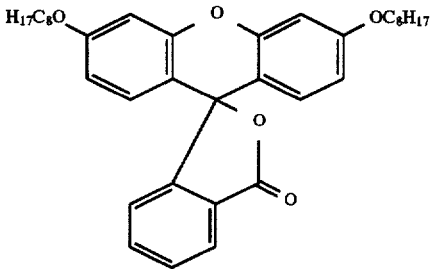
(6)
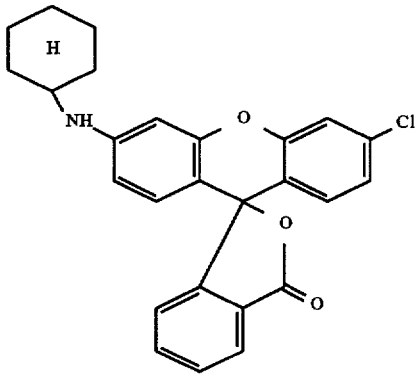
(7)
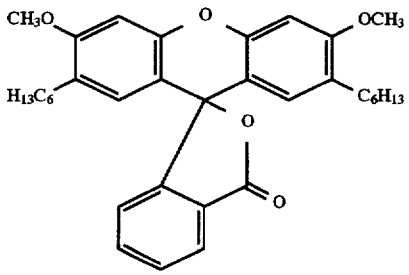
-continued
(8)
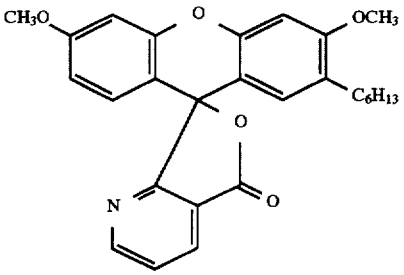
(9)
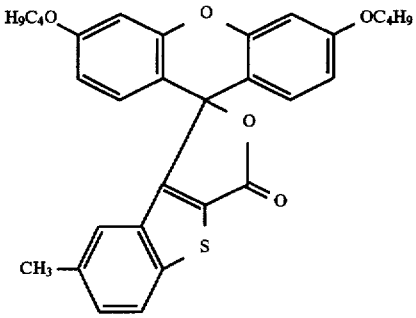
(10)
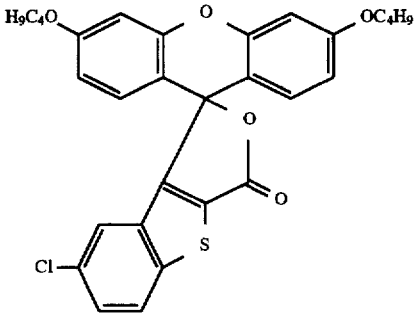
(11)
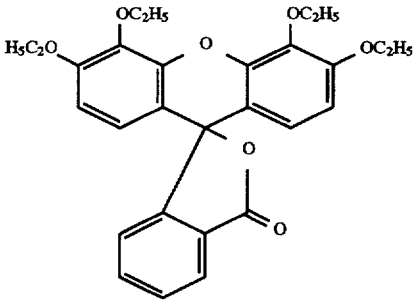
(12)
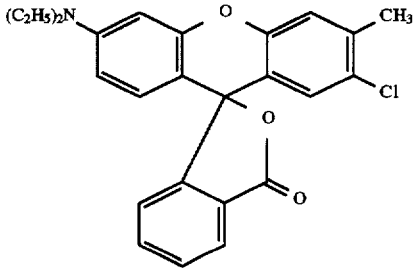

-continued
(13)
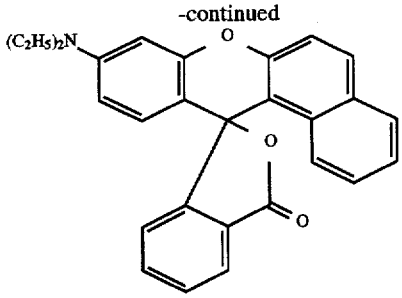
(14)
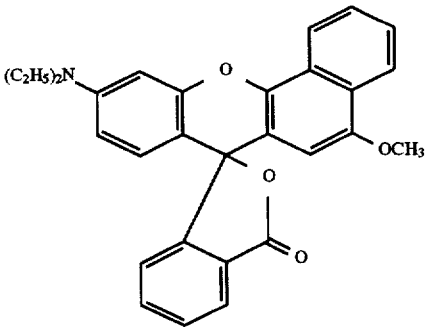
(15)
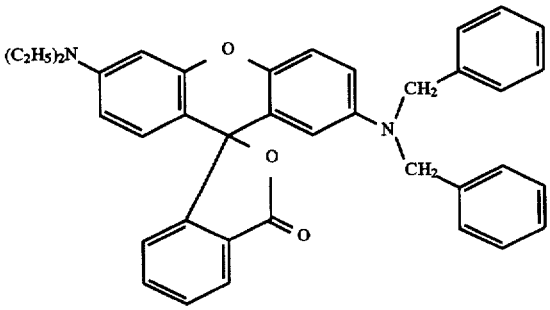
(16)
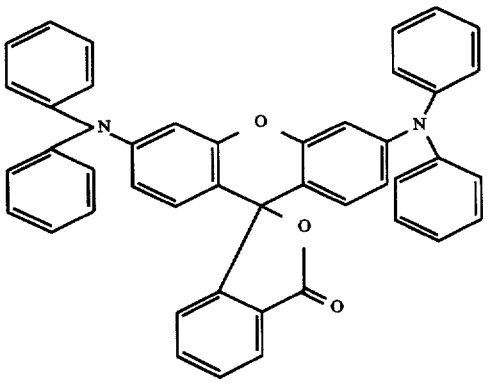
(17)
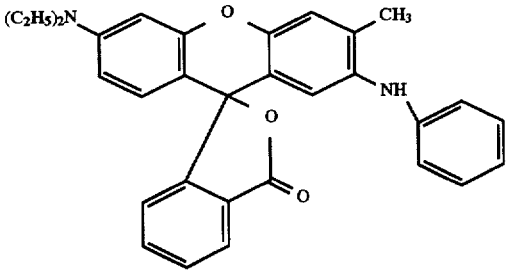
-continued
(18)
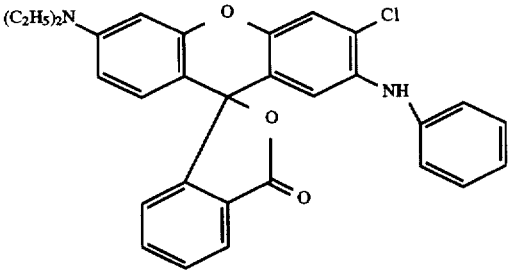
(19)
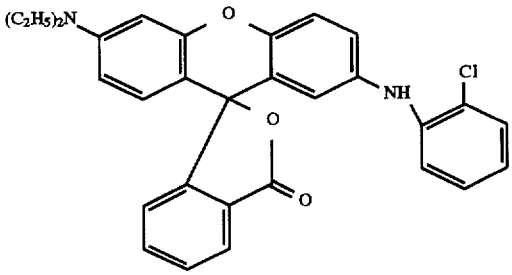
(20)
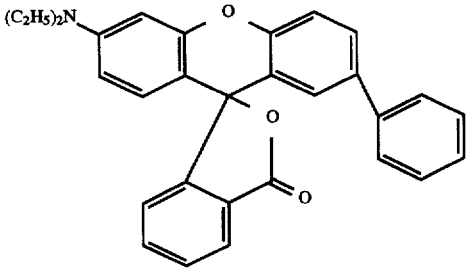
(21)
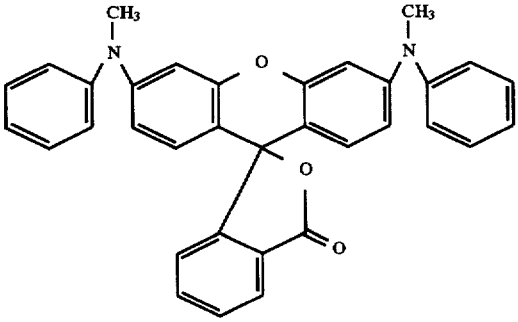
(3) Indolylphthalides:
(22)
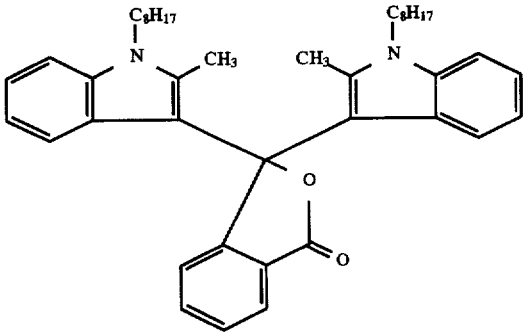

-continued
(23)
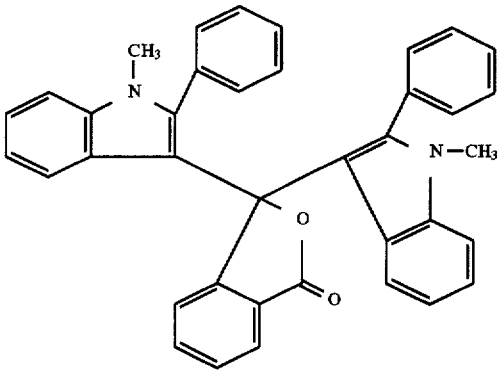
(24)
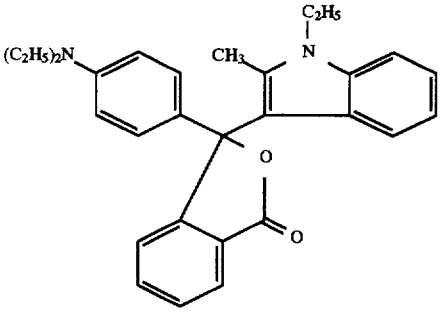
(25)
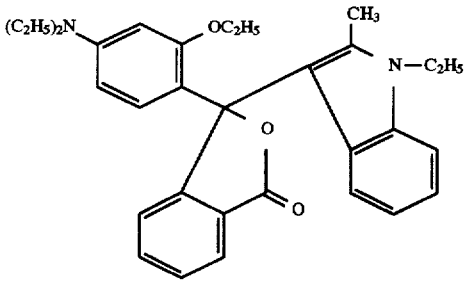
(26)
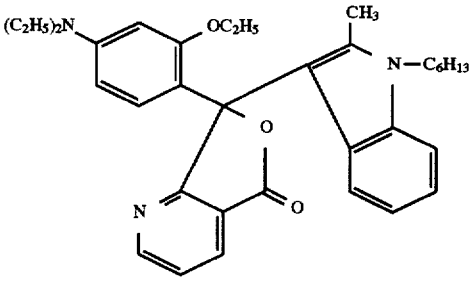
(27)
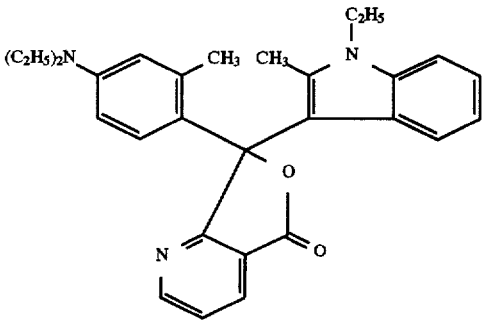
-continued
(28)
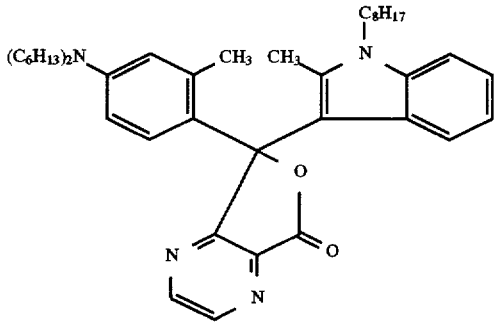
(29)
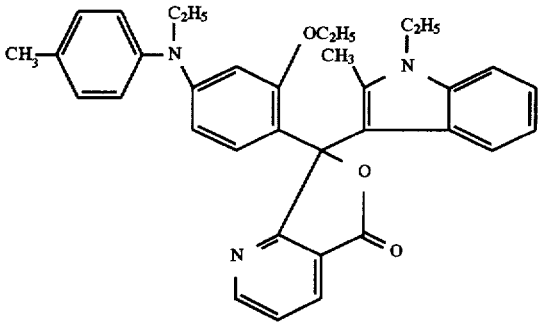
(30)
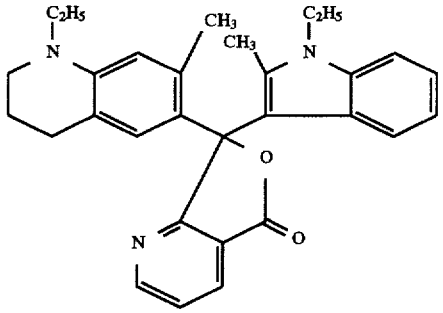
(31)
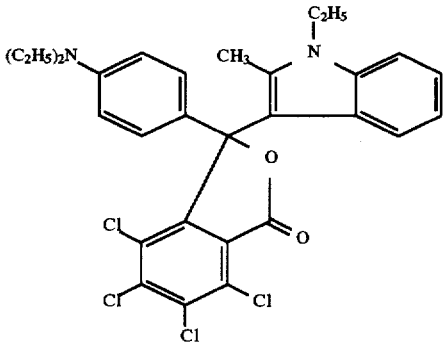
(4) Acylleucoazines:
(32)
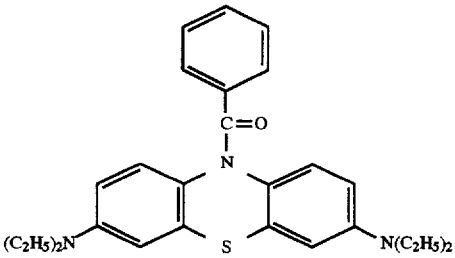

-continued
(33)
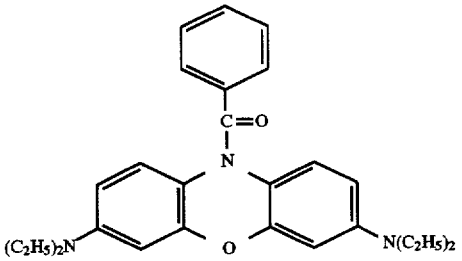
(34)
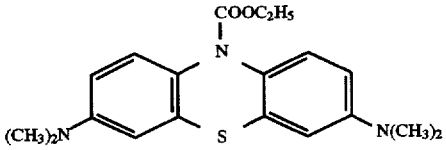
(35)
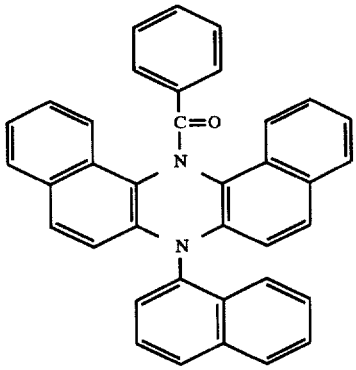
(5) Leucoauramines:
(36)
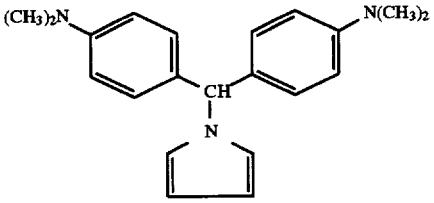
(37)
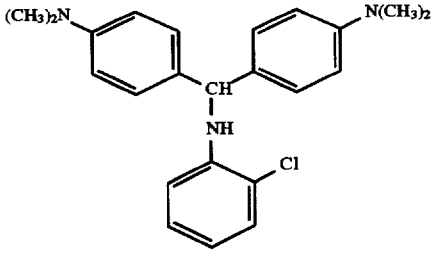
(38)
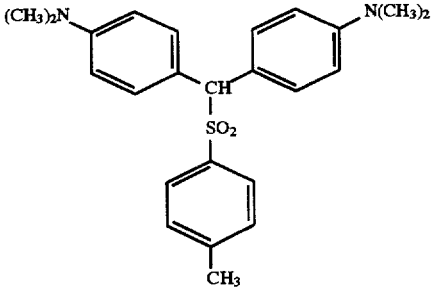
-continued
(39)
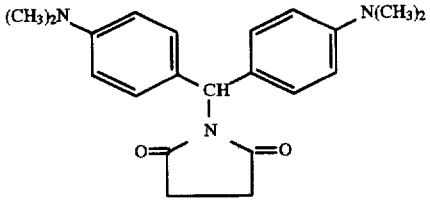
(6) Spiropyrans:
(40)
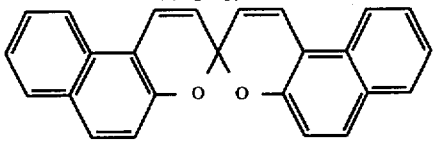
(41)
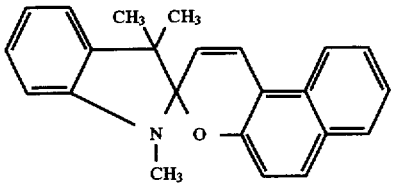
(7) Rhodamine Lactams:
(42)
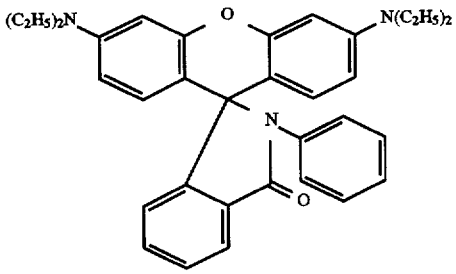
(43)
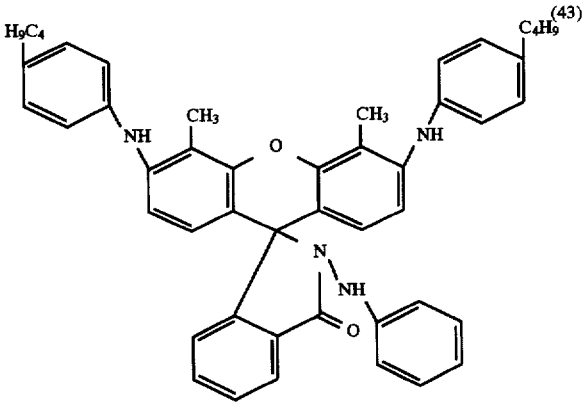
(8) Triarylmethanes:
(44)
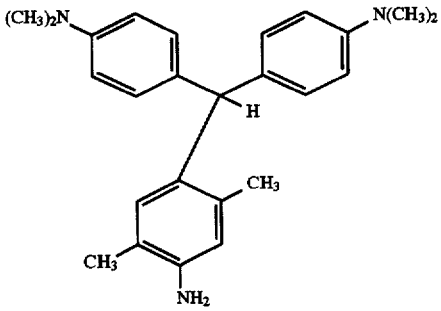

-continued (45)

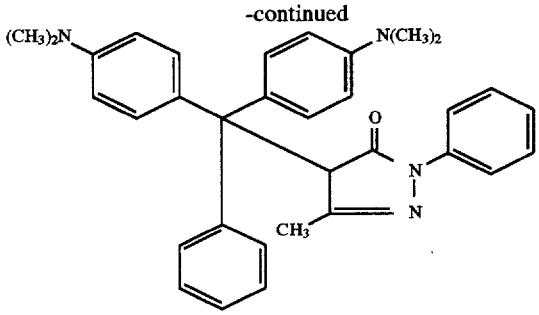

(46)

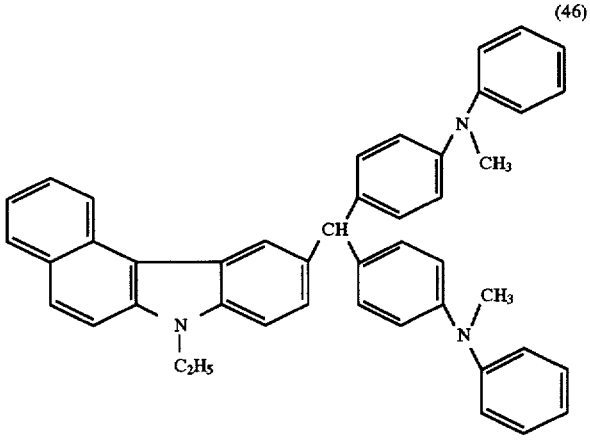

(47)

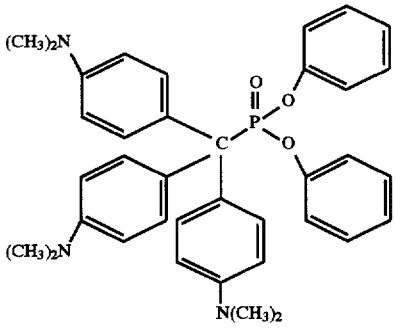

(9) Chromenes:

(48)

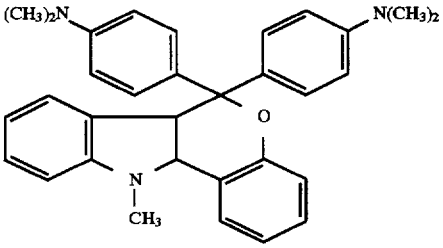

(49)

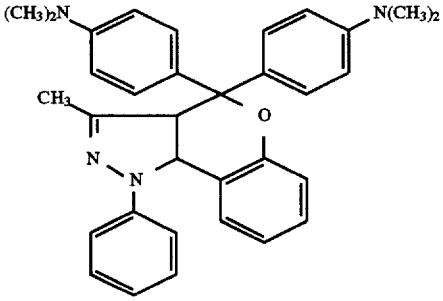

-continued (50)

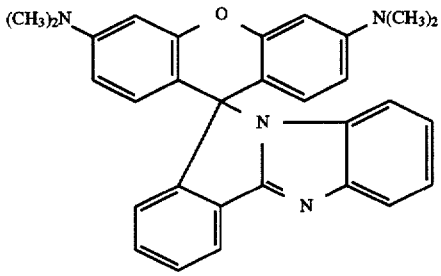

(10) Others:

(51)

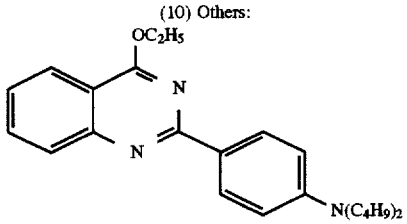

(52)

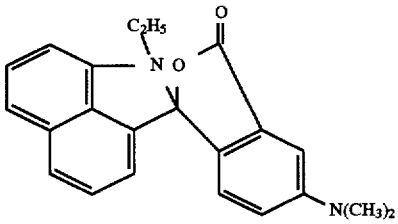

(53)

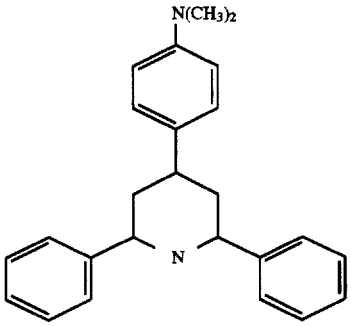

In recent years, laser light sources such as semiconductor lasers have rapidly prevailed. When these light sources are used, leuco dyes whose color is developed in the wavelength region of longer than 620 nm can be used. Of the leuco dyes, 2,6-diaminofluoran compounds having a cyclic structure at the 2- and 3-positions are described in JP-A-3-14878, JP-A-3-244587 and JP-A-4-173288; fluoran compounds having a p-phenylenediamine moiety at a substituent are described in JP-A-61-284485 and JP-A-3-239587; thiofluoran compounds are described in JP-A-52-106873; 3,3-bis(4-substituted aminophenol)azaphthalide compounds are described in JP-A-5-139026 and JP-A-5-179151; phthalide compounds having a vinyl group are described in JP-B-58-5940, JP-B-58-27825 and JP-B-62-24365; fluorene compounds are described in JP-A-63-94878 and JP-A-3-202386; sulfonylmethane compounds having a vinyl group are described in JP-A-60-230890 and JP-A-60-231766; and compounds having a phenothiazine or phenoxazine ring are described in JP-A-63-199268. Specific examples thereof include the following leuco dyes:

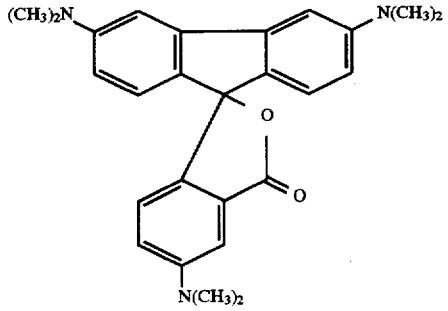
(54)
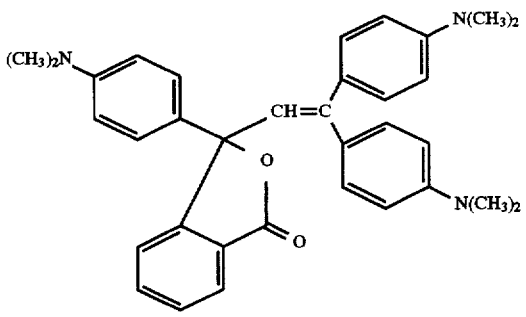
(55)
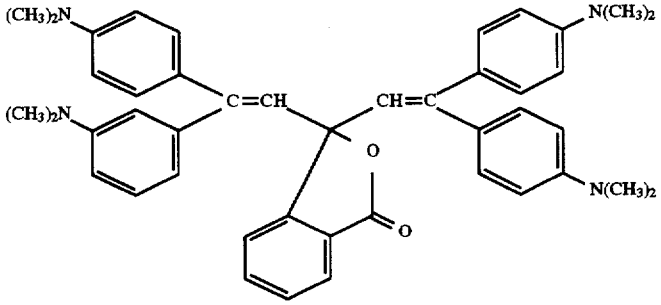
(56)
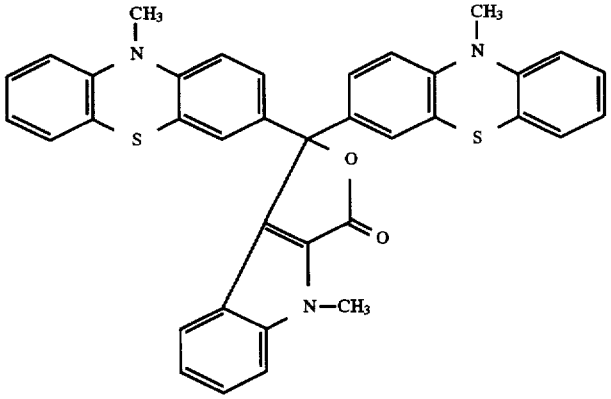
(57)
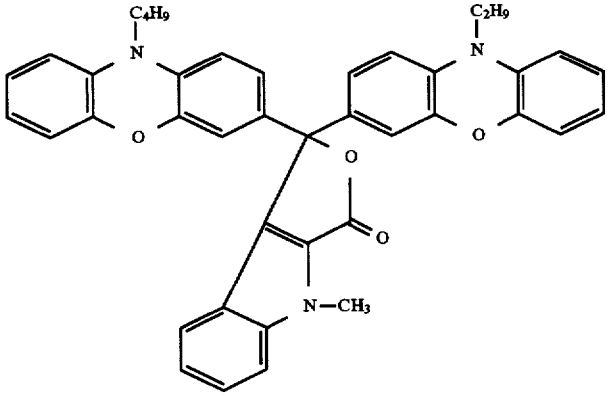
(58)

-continued
(59)
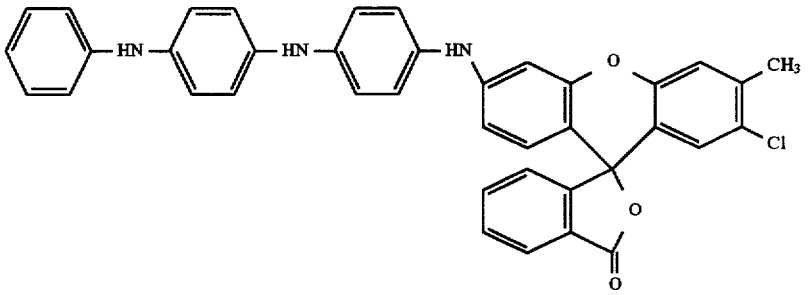
(60)
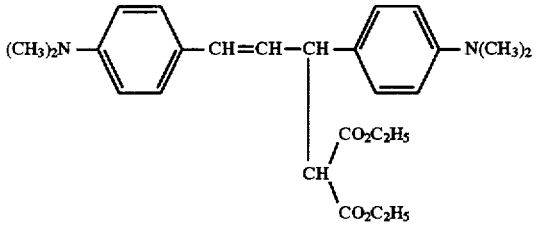
(61)
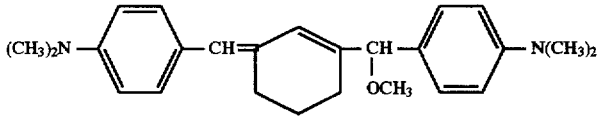
(62)
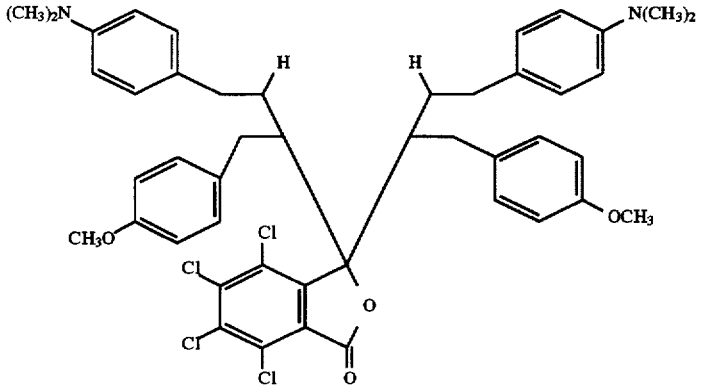
(63)
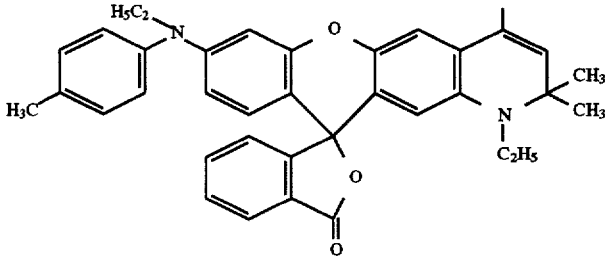
(64)
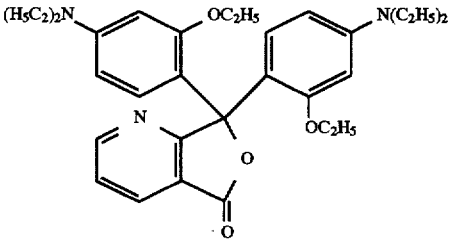
(65)
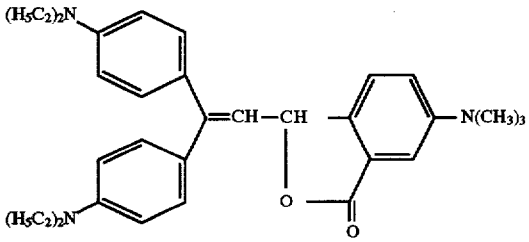

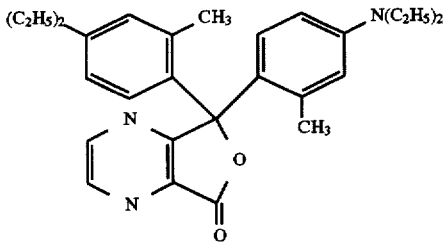

The examples are some of the leuco dyes, and the leuco dyes for use in the present invention are not limited thereto.

Examples of the color developer for use in the present invention include metal salts of organic acids, as well as color developers of the acid clay family (clay) and phenol-formaldehyde resins (e.g., p-phenylphenol-formaldehyde resin). Examples of the metal salt of the organic acid include metal salts of salicylic acid derivatives, metal salts of phenol-salicylic acid-formaldehyde resins, metal salts of o-sulfonamidobenzoic acid, metal salts of phenol-formaldehyde resins, rhodanides, metal salts of xanthogenic acid. As the metal, zinc is particularly preferably used. Of the color developers, oil-soluble zinc salicylate is described in, e.g., U.S. Pat. Nos. 3,864,146 and 4,046,941, and JP-B-52-1327.

Preferable examples of the metal salts of the organic acids are shown below:

(1)

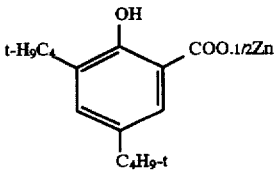

(2)

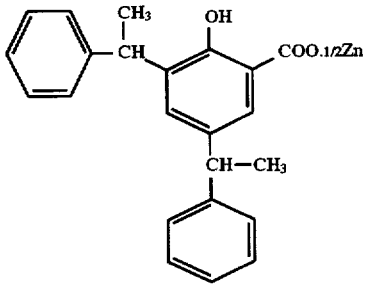

(3)

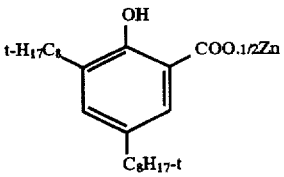

-continued (66)

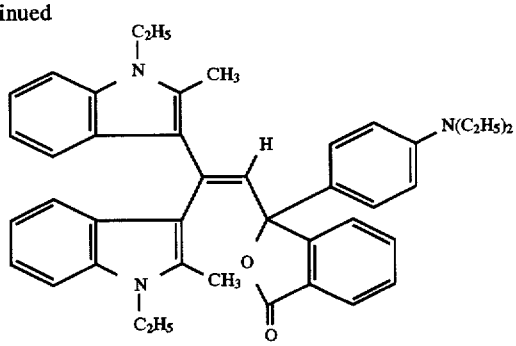

(67)

-continued (4)

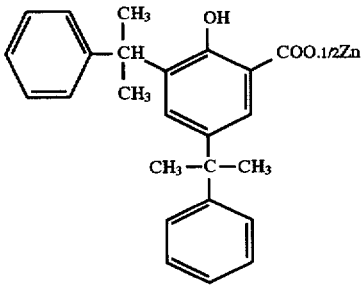

(5)

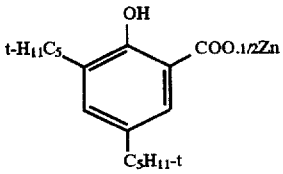

(6)

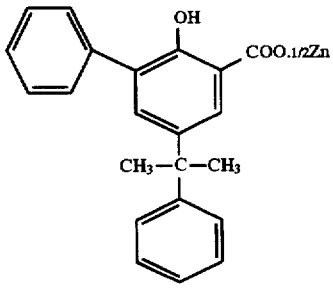

(7)

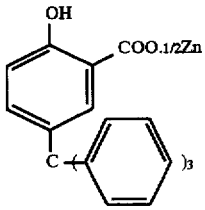

(8)

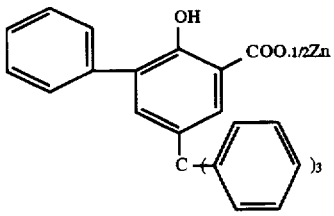

-continued (9)

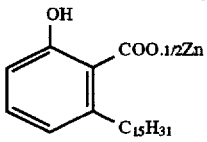

(10)

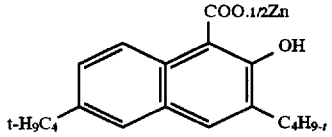

(11)

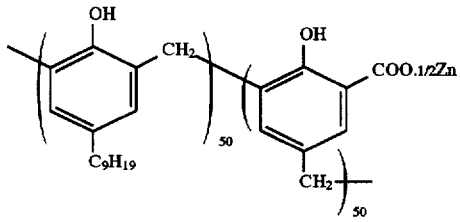

(12)

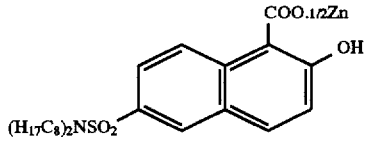

(13)

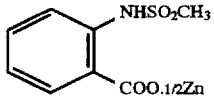

(14)

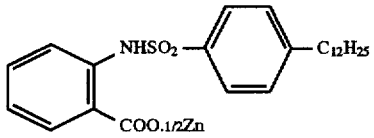

(15)

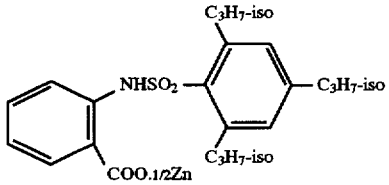

(16)

Zn salt of

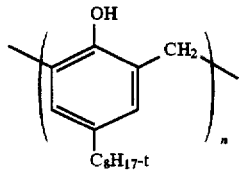

(17)

Zn salt of

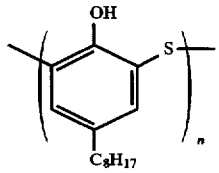

(18)

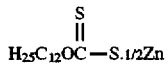

-continued (19)

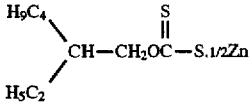

(20) $Zn(SCN)_2$

(21) Complex of Zn(SCN) and

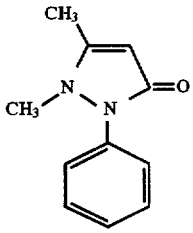

(22)

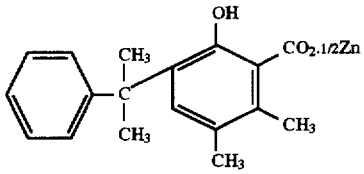

(23)

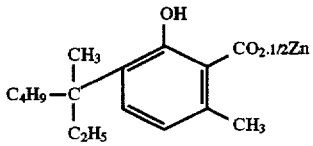

(24)

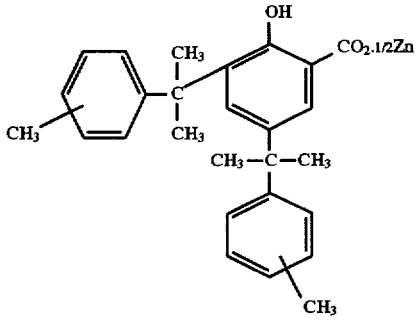

In the present invention, the leuco dye and color developer are required to be mixed to develop color before exposure of the silver halide light-sensitive material. The leuco dye and the color developer previously mixed to develop color may be added to coating solutions, or may be separately added to coating solutions to develop color in the coating solutions.

In the present invention, the leuco dye may be used either alone or as a combination of two or more of them. When two or more kinds of them are used in combination, the leuco dye giving the same color or different colors may be combined. The leuco dye may be used in several layers so as to give different colors for the respective layers if necessary.

The color developers may usually be employed alone, but may be used as a combination of two or more kinds of them.

The colored composition produced by the leuco dye and the color developer in the present invention may be added to any layers of the light-sensitive material. That is, any layers of light-sensitive material may be colored layers in the present invention. For example, the colored composition of the present invention may be added to a silver halide emulsion layer for preventing irradiation, and may be added to a protective layer as a filter dye. Furthermore, it may be added to a layer under an emulsion layer or a back surface of a support for preventing halation.

The amount added of the leuco dye of the present invention is 1 to $1\times10^4$ mg/m$^2$, and preferably 1 to $1\times10^3$ mg/m$^2$. Furthermore, the amount added of the color developer of the present invention is 0.1 to 10 mol equivalents, preferably 0.5 to 4 mol equivalents, per the leuco dyes.

The compounds (leuco dyes and color developers) of the present invention may be added by the methods described in U.S. Pat. No. 2,322,027. For example, the compounds are dissolved in high boiling organic solvents such as alkyl phthalates (e.g., dibutyl phthalate, dioctyl phthalate), phosphates (e.g., diphenyl phosphate, triphenyl phosphate, tricresyl phosphate, dioctyl butyl phosphate), citrates (e.g., tributyl acetylcitrate), benzoates (e.g., octyl benzoate), alkylamides (e.g., diethyllaurylamide), fatty acid esters (e.g., dibutoxyethyl succinate, diethyl azelate) and trimesates (e.g., tributyl trimesate), or in low boiling organic solvents having a boiling point of about 50° C. to 160° C., for example, lower alkyl acetates such as ethyl acetate and butyl acetate, ethyl propionate, secondary butyl alcohol, methyl isobutyl ketone, β-ethoxyethyl acetate and methyl cellosolve acetate, and then, the resulting solutions are dispersed in hydrophilic colloids. The high boiling solvents and low boiling solvents may be mixed with each other.

Dispersing methods using polymers described in JP-B-51-39853 and JP-A-51-59943 can also be used.

Furthermore, the compounds of the present invention can be introduced into hydrophilic colloids as alkaline aqueous solutions or together with surfactants.

Moreover, the compounds of the present invention can be also dispersed in water-soluble organic solvents such as N,N-dimethylformamide, N,N-dimethylacetamide and methyl cellosolve, or the resulting dispersion can also be further diluted with water, thereby adding the compounds.

When the compounds of the present invention are added, acids may be added at the same time as so desired. The acids may be either organic acids or inorganic acids. They may also be acidic polymers.

In the present invention, the combinations of the slightly water-soluble basic metal compound used as a base precursor and the compound (complex-forming compound, hereinafter often referred to as a "complexing agent") which can undergo complex formation with the metal ion constituting the basic metal compound through water as a medium are disclosed in JP-A-62-129848 and EP-A-210660.

Preferred examples of the basic metal compound include oxides, hydroxides and basic carbonates of zinc or aluminum, and zinc oxide. Particularly, zinc hydroxide and basic zinc carbonate are preferred.

The slightly water-soluble basic metal compound is dispersed as fine particles in a hydrophilic binder as described in JP-A-59-1748300. The mean particle size of the fine particles is 0.001 to 5 μm, and preferably 0.01 to 2 μm. The amount of the fine particles contained in the light-sensitive material is 0.01 to 5 g/m$^2$, and preferably 0.05 to 2 g/m$^2$.

The complexing agent for use in the sheet containing the complex-forming compound (hereinafter often referred to as a "complexing agent sheet") in the present invention are known as chelating agents in analytical chemistry and as a water softener in photochemistry. Details thereof are described in A. Ringbom, translated by Nobuyuki Tanaka and Haruko Sugi, *Complex Formation* (Sangyo Tosho), as well as the above-described patents.

The complexing agent for use in the present invention is preferably a water-soluble compound. Examples thereof include aminopolycarboxylic acids (including salts thereof) such as ethylenediaminetetraacetic acid, nitrilotriacetic acid and diethylenetriaminepentaacetic acid, aminophosphonic acids (including salts thereof) such as amino-tris (methylenephosphonic acid) and ethylenediaminetetramethylenephosphonic acid, and pyridinecarboxylic acids (including salts thereof) such as 2-picolinic acid, pyridine-2,6-dicarboxylic acid and 5-ethyl-2-picolinic acid. Of these, pyridinecarboxylic acids and salts thereof are particularly preferred.

In the present invention, it is preferred that the complexing agent be used as a salt neutralized with a base. In particular, salts of organic bases such as guanidines, amidines and tetraalkylammonium hydroxides are preferably used. Preferred examples of the complexing agents are described in JP-A-62-129848 and EP-A-210660 described above.

When these complexing agents are used, leuco dye reciprocity is hard to occur because they form a stable complex with a metal ion in the colored composition. Accordingly, they are advantageously used.

When the complexing agent is added to the complexing agent sheet, the amount thereof is 0.01 to 10 g/m$^2$, and preferably 0.05 to 5 g/m$^2$.

In the present invention, the physical development nucleus is added to the complexing agent sheet. The physical development nucleus reduces a diffused movable silver salt to silver, thus fixing silver to a fixing layer.

As the physical development nucleus, all the physical development nuclei previously known can be used. Examples thereof include heavy metals such as zinc, mercury, lead, cadmium, iron, chromium, nickel, tin, cobalt and copper, noble metals such as palladium, platinum, silver and gold, and sulfides, selenides and tellurides of these various metals. These physical development nucleus compounds are obtained by reducing the corresponding metal ions to produce metal colloidal dispersions, or by mixing metal ion solutions with solutions of soluble sulfides, selenides or tellurides to produce colloidal dispersions of water-insoluble metal sulfides, metal selenides or metal tellurides.

These physical development nucleus is added to the complexing agent sheet usually in an amount of $10^{-6}$ to $10^{-1}$ g/m$^2$, and preferably in an amount of $10^{-5}$ to $10^{-2}$ g/m$^2$, and is preferably added to the outside layer.

The physical development nucleus separately prepared can also be added to a coating solution. However, for example, silver nitrate and sodium sulfide, or chloroauric acid and a reducing agent may react with each other in a coating solution containing a hydrophilic binder to produce the physical development nucleus.

Examples of the physical development nucleus include silver, silver sulfide, palladium sulfide. In particular, when physical development silver transferred to the complexing agent sheet is used as an image, palladium sulfide and silver sulfide are preferred in that Dmin be decreased.

The solvent for silver halide may be used in combination in the complexing agent sheet of the present invention if necessary. Examples thereof include thiosulfates such as sodium thiosulfate and ammonium thiosulfate, sulfites such as sodium thiosulfite, organic thioether compounds such as 1,8-dihydroxy-3,6-dithiaoctane, 2,2'-thiodiethanol and 6,9-dioxa-3,12-dithiatetradecane-1,14-diol described in JP-B-47-11386, compounds having imido rings such as uracil, 5-methyluracil and thiohydantoin described in Japanese Patent Application No. 6-325350, and compounds of the following formula described in JP-A-53-144319:

$$N(R^1)(R^2)—C(=S)—X—R^3$$

wherein X represents a sulfur atom or an oxygen atom; $R^1$ and $R^2$, which may be the same or different, each represents an aliphatic group, an aryl group, a heterocyclic residue or an amino group; $R^3$ represents an aliphatic group or an aryl group; and $R^1$ and $R^2$, or $R^2$ and $R^3$ may be combined with each other to form a 5- or 6-membered heterocyclic ring.

Of these compounds, particularly preferred solvents for silver halide are compounds having imido rings such as uracil, 5-methyluracil, 4-methyluracil, thiohydantoin and succinimide.

The content of the solvents for silver halide in the complexing agent sheet is 0.01 to 5 g/m$^2$, and preferably 0.05 to 2.5 g/m$^2$. Furthermore, it is 1/20 to 20 times the amount of silver coated in molar ratio, and preferably 1/10 to 10 times. The solvent for silver halides may be dissolved in a solvent such as water, methanol, ethanol, acetone and DMF, or in an alkaline aqueous solution to add to a coating solution, or can also be used as fine a solid particle dispersion.

The heat developable light-sensitive material for use in the present invention basically has a light-sensitive silver halide, a hydrophilic binder, a reducing agent and a slightly water-soluble basic metal compound on the support, and can further contain an organic metal salt oxidizing agent, or a dye-donating compound, if necessary.

In many cases, these components are added to the same layer. However, they can be separately added to different layers, as long as they are in a reactive state. The reducing agent is preferably contained in the heat developable light-sensitive material. However, they may be supplied from the outside, for example, by diffusion from the complexing agent sheet.

When the light-sensitive material of the present invention is a color light-sensitive material, it preferably has three kinds of light-sensitive layers, a blue-sensitive emulsion layer, a green-sensitive emulsion layer and a red-sensitive emulsion layer. However, another color sensitive layer such as an infrared-sensitive layer can also be used. Furthermore, it may have a non-light-sensitive layer such as a yellow filter layer (the dye composition of the present invention can be used) for decreasing the blue sensitivity of the green-sensitive emulsion layer and the red-sensitive emulsion layer, an intermediate layer for decreasing color amalgamation in development between light-sensitive layers different from each other in color sensitivity, or provided between layers having the same color sensitivity, or an antihalation layer (the dye composition of the present invention can be used) for preventing halation. In order to improve the color reproducibility, a donor layer having multilayer effect different from a main light-sensitive layer such as a blue-sensitive emulsion layer, a green-sensitive emulsion layer or a red-sensitive emulsion layer in spectral sensitivity distribution may be arranged adjacent to or in close proximity to the main light-sensitive layer, as described in, for example, U.S. Pat. Nos. 4,663,271, 4,705,744 and 4,707,436, JP-A-62-160448 and JP-A-63-89850.

In a plurality of silver halide emulsion layers constituting each unit sensitive layer, the two layer constitution of an emulsion layer of high sensitivity and an emulsion layer of low sensitivity can be used as required, as described in West German Patent 1,121,470 or British Patent 923,045. Usually, they are preferably arranged in order to lower the degrees of sensitivity toward a support, and a non-light-sensitive layer may be provided between the respective silver halide emulsion layers. Furthermore, the emulsion layer of low sensitivity may be formed far away from a support and the emulsion layer of high sensitivity may be formed close to the support, as described in JP-A-57-112751, JP-A-62-200350, JP-A-62-206541, and JP-A-62-206543.

For example, the sensitive layers can be arranged in the order of a blue-sensitive layer of low sensitivity (BL), a blue-sensitive layer of high sensitivity (BH), a green-sensitive layer of high sensitivity (GH), a green-sensitive layer of low sensitivity (GL), a red-sensitive layer of high sensitivity (RH) and a red-sensitive layer of low sensitivity (RL), in the order of BH, BL, GL, GH, RH and RL, or in the order of BH, BL, GH, GL, RL and RH from the farthest side from a support.

The sensitive layers can also be arranged in the order of a blue-sensitive layer, GH, RH, GL and RL from the farthest side from a support as described in JP-B-55-34932. Furthermore, they can also be arranged in the order of a blue sensitive layer, GL, RL, GH and RH from the farthest side from a support as described in JP-A-56-25738 and JP-A-62-63936.

Furthermore, three layers different in light sensitivity may be arranged so that the upper layer is a silver halide emulsion layer having the highest light sensitivity, the middle layer is a silver halide emulsion layer having a light sensitivity lower than that of the upper layer, the lower layer is a silver halide emulsion layer having a light sensitivity further lower than that of the middle layer, and the sensitivity of the three layers is successively decreased toward a support, as described in JP-B-49-15495. Even when such three layers different in light sensitivity are arranged, they may be arranged in the order of an emulsion layer of intermediate sensitivity, an emulsion layer of high sensitivity and an emulsion layer of low sensitivity from the side remote from a support in the layers having the same color sensitivity, as described in JP-A-59-202464.

In addition, they may be arranged in the order of an emulsion layer of high sensitivity, an emulsion layer of low sensitivity and an emulsion layer of intermediate sensitivity, or in the order of an emulsion layer of low sensitivity, an emulsion layer of intermediate sensitivity and an emulsion layer of high sensitivity. In the case of four layers or more, the arrangement may also be changed as described above.

In the present invention, various layer constitutions and layer arrangements can be selected as described above according to the purpose of each light-sensitive material.

Furthermore, as described in JP-A-7-5647, finely divided, substantially non-light-sensitive silver halide grains can also be added to at least one light-sensitive silver halide emulsion layer and/or a layer adjacent to the light-sensitive silver halide emulsion layer on the side near to a support. The finely divided, substantially non-light-sensitive silver halide grains and the content thereof are described in detail in the specification.

The light-sensitive material may be provided with various non-light-sensitive layers such as a protective layer, an undercoat layer, an intermediate layer, a filter layer and an antihalation layer, between the silver halide emulsion layers and as the uppermost and lowermost layers, and can be provided with various supplementary layers such as a back layer on the side opposite to each of the support. Specifically, the light-sensitive material can be provided with an undercoat layer as described in U.S. Pat. No. 5,051,335, an intermediate layer containing a reducing agent or DIR compound as described in JP-A-1-120553, JP-A-5-34884 and JP-A-2-64634, an intermediate layer containing an electron transfer agent as described in U.S. Pat. Nos. 5,017,454 and 5,139,919 and JP-A-2-235044, a protective layer containing a reducing agent as described in JP-A-4-249245, or combined layers thereof.

The silver halide emulsion for use in the present invention is preferably silver chloride, silver bromide, silver iodobromide, silver chlobromide, silver iodochloride, or silver iodochlorobromide. Particularly, when an image is formed according to silver salt diffusion transfer by using a complexing agent sheet containing a silver halide solvent and a physical development nucleus, the silver chloride content in silver halide is preferably 80 mol % or more.

The silver halide emulsion for use in the present invention may be either a surface latent image emulsion or an internal latent image emulsion. The internal latent image emulsion is used as a direct reversal emulsion in combination with a nucleating agent or light fogging. Furthermore, the emulsion may be a core/shell emulsion in which the insides of grains are different from the surfaces thereof in the phase, and silver halides different in composition may be joined by epitaxial junction. Furthermore, the silver halide emulsion may be either a monodisperse emulsion or a polydisperse emulsion, and the method is preferably used in which monodisperse emulsions are mixed to adjust gradation as described in JP-A-1-167743 and JP-A-4-223463. The grain size is preferably 0.01 to 2 μm, and more preferably 0.1 to 1.5 μm. The silver halide grains may be any of a regular crystal form such as a cubic, an octahedral or a tetradecahedral form, an irregular crystal form such as a spherical form or a plate (tabular) form high in aspect ratio, a form having a crystal defect such as a twin plane, and a combined form thereof.

Specifically, there can be used any of silver halide emulsions prepared by methods described in U.S. Pat. No. 4,500,626 (col.50); U.S. Pat. No. 4,628,021; RD, No. 17029 (1978); RD, No. 17643, pp.22–23 (December 1978); RD, No. 18716, p.648 (November 1979); RD, No. 307105, pp.863–865 (November 1989); JP-A-62-253159; JP-A-64-13546; JP-A-2-236546; JP-A-3-110555; P. Glafkides, *Chemie et Phisique Photographique* (Paul Montel, 1967); G. F. Duffin, *Photographic Emulsion Chemistry* (Focal Press, 1966); and V. L. Zelikman et al., *Making and Coating Photographic Emulsion* (Focal Press, 1964).

During preparation of the silver halide emulsion in the present invention, salt removal for removing excess salts is preferably conducted. Water washing with noodle may be used which is conducted by gelation of gelatin, and precipitation (flocculation) may also be used in which multiply charged anionic inorganic salts (e.g., sodium sulfate), anionic surfactants, anionic polymers (e.g., sodium polystyrenesulfonate) or gelatin derivatives (e.g., aliphatic acylated gelatin, aromatic acylated gelatin and aromatic carbamoylated gelatin) are utilized. The precipitation is preferably used.

For various purposes, the light-sensitive silver halide emulsion for use in the present invention may contain a heavy metal such as iridium, rhodium, platinum, cadmium, zinc, thallium, lead, iron and osmium. These metals may be used alone or in combination. The amount added is about $10^{-9}$ to $10^{-3}$ mol per mol of silver halide, although it depends on the purpose of use. They may be uniformly added to grains or localized in the insides or on surfaces thereof. Specifically, emulsions described in JP-A-2-236542, JP-A-1-116637 and JP-A-5-181246 are preferably used.

In the grain formation stage of the light-sensitive silver halide emulsions for use in the present invention, rhodanides, ammonia, 4-substituted thioether compounds, organic thioether derivatives described in JP-B-47-11386 or sulfur-containing compounds described in JP-A-53-144319 can be used as solvents for silver halides.

Other conditions are also referred to P. Glafkides, *Chemie et Phisique Photographique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964). The preparation methods may be any of acidic, neutral and ammonia processes. A soluble silver salt and a soluble halogen salt may be reacted with each other by using any of a single jet method, a double jet method and a combination thereof. The double jet method is preferably used for obtaining a mono dispersion emulsion.

A reverse mixing method in which grains are formed in the presence of excess silver ions can also be used. As a type of double jet method, there can also be used a method for maintaining constant the pAg in a liquid phase in which a silver halide is formed, namely a so-called controlled double jet method.

The rate of addition, the amount or the concentration of silver salt solutions (e.g., aqueous solution of $AgNO_3$) and halogen compound solutions (e.g., aqueous solution of KBr) added in formation of the silver halide grains may be increased to speed up the formation of the grains e.g., JP-A-55-142329, JP-A-55-158124, U.S. Pat. No. 3,650,757).

Furthermore, the reaction solutions may be stirred by any known methods. The temperature and the pH of the reaction solutions during formation of the silver halide grains may be arbitrarily established depending on the purpose. The pH preferably ranges from 2.7 to 7.0, and more preferably from 2.5 to 6.0.

In the present invention, the silver halide emulsions can be used as such, without chemical sensitization, but usually chemical sensitization. With respect to chemical sensitization for use in the present invention, chalcogen sensitization such as sulfur sensitization, selenium sensitization and tellurium sensitization; noble metal sensitization using gold, platinum or palladium; and reduction sensitization can be used alone or in combination (e.g., JP-A-3-110555, JP-A-5-241267). The chemical sensitization can be conducted in the presence of nitrogen-containing heterocyclic compounds (e.g., JP-A-62-253159). Furthermore, antifoggants given later can be added after end of chemical sensitization. Specifically, methods described in JP-A-5-45833 and JP-A-62-40446 can be used.

The pH on chemical sensitization is preferably 5.3 to 10.5, and more preferably 5.5 to 8.5, and the pAg is preferably 6.0 to 10.5, and more preferably 6.8 to 9.0.

The coated amount of the light-sensitive silver halide emulsion for use in the present invention is preferably 1 $mg/m^2$ to 10 $g/m^2$ in terms of silver.

In order to give the color sensitivities of green, red and infrared sensitivities to the light-sensitive silver halide emulsion of the present invention, the light-sensitive silver halide emulsion is spectrally sensitized with a methine dye or others. Furthermore, a blue-sensitive emulsion may be spectrally sensitized at a blue color region, if necessary.

In particular, when the silver halide emulsion is used for laser exposure (e.g., image setters, color scanners), spectral sensitization fitting the wavelength of each laser is required.

Examples of the dyes include cyanine dyes, merocyanine dyes, complex cyanine dyes, complex merocyanine dyes, holopolarcyanine dyes, hemicyanine dyes, styryl dyes and hemioxonol dyes. Dyes belonging to the cyanine dyes, the merocyanine dyes and the complex merocyanine dyes are particularly useful. Any nuclei usually utilized in cyanine dyes as basic heterocyclic ring nuclei can be applied to these dyes. That is, examples of the applied nuclei include pyrroline, oxazoline, thiazoline, pyrrole, oxazole, thiazole, selenazole, imidazole, tetrazole and pyridine nuclei; nuclei in which alicyclic hydrocarbon rings are fused together with these nuclei; and benzindolenine, indole, benzoxazole, naphthoxazole, benzothiazole, naphthothiazole, benzoselenazole, benzimidazole and quinoline nuclei. These nuclei may be substituted at carbon atoms.

To the merocyanine dyes or the complex merocyanine dyes, 5- or 6-membered heterocyclic nuclei such as pyrazoline-5-one, thiohydantoin, 2-thioxazolidine-2,4-dione, thiazolidine-2,4-dione, rhodanine and thiobarubituric acid nuclei can be applied as nuclei having the keto-methylene structure.

Examples thereof include sensitizing dyes described in U.S. Pat. No. 4,617,257, JP-A-59-180550, JP-A-64-13546, JP-A-5-45828 and JP-A-5-45834.

These sensitizing dyes may be used alone or in combination. The combinations of the sensitizing dyes are often used, particularly for adjusting the wavelength in supersensitization and spectral sensitization.

The emulsion may contain dyes which have no spectral sensitization action themselves or compounds which do not substantially absorb visible light, but exhibit supersensitization, in combination with the sensitizing dyes (e.g., U.S. Pat. No. 3,615,641, JP-A-59-192242, JP-A-59-191032, JP-A-63-23145). In particular, the compounds described in JP-A-59-191032 and JP-A-59-192242 are preferably used, when the sensitizing dyes having the spectral sensitization sensitivity from the red region to the infrared region are used.

The dyes may be added in any stage of the emulsion preparation. Most normally, they are added during a period from completion of chemical sensitization up to before coating, but they can be added simultaneously with addition of the chemical sensitizers to conduct spectral sensitization and chemical sensitization at the same time as described in U.S. Pat. Nos. 3,628,969 and 4,225,666, or they can be added before chemical sensitization as described in JP-A-58-113928 and JP-A-4-63337. Furthermore, they can be added before completion of precipitation formation of the silver halide grains to initiate spectral sensitization. Moreover, it is also possible to add these compounds in parts, namely to add a part thereof before chemical sensitization and the residue after chemical sensitization, as taught in U.S. Pat. No. 4,225,666, and they may be added at any time during formation of the silver halide grains, including methods described in U.S. Pat. No. 4,183,756.

The amount added is from $9\times10^{-9}$ mol to $9\times10^{-3}$ mol per mol of silver halide.

These sensitizing dyes and supersensitizers may be added as solutions thereof in hydrophilic organic solvents such as methanol, aqueous solutions thereof (sometimes, they may be basic or acidic to enhance the solubility), dispersions in gelatin or surfactant solutions thereof.

In order to enhance adsorption of the sensitizing dyes, soluble Ca compounds, soluble Br compounds, soluble I compounds, soluble Cl compounds or soluble SCN compounds may be added before, after or during addition of the sensitizing dyes. These compounds may be used in combination. Preferably, $CaCl_2$, KI, KCl, KBr and KSCN are used. Furthermore, they may be fine silver bromide, silver chlorobromide, silver iodobromide, silver iodide and silver rhodanide grain emulsions.

There is no particular limitation on other additives added to the light-sensitive material to which the emulsions are applied in the present invention. For example, reference can be made to the descriptions of RD, vol. 176, No. 17643 (RD-17643); RD, vol. 187, No. 18716 (RD-18716); and RD, vol. 307, No. 307105 (RD-307015).

As to additives used in such stages and known light-sensitive additives available in the light-sensitive material and the complexing agent sheet used in the present invention, RD-17643, RD-18716 and RD-307105 are listed in which the various additives are described.

| Additive | RD-17643 | RD-18716 | RD-307105 |
|---|---|---|---|
| 1. Chemical sensitizers | p. 23 | p. 648, right column (RC) | p. 866 |
| 2. Sensitivity increasing agents | | ditto | |
| 3. Spectral sensitizers, Supersensitizers | pp. 23–24 | p. 648, RC to p. 649, RC | pp. 866–868 |
| 4. Brightening agents | p.24 | p. 648, RC | p. 868 |
| 5. Antifoggants, Stabilizers | pp. 24–25 | p. 649, RC | pp. 868–870 |
| 6. Light absorbing agents, Filter dyes, Ultraviolet absorbing agents | pp. 25–26 | p. 649, RC to p. 650, left column (LC) | p. 873 |
| 7. Dye image stabilizers | p. 25 | p. 650, LC | p. 872 |
| 8. Hardening agents | p. 26 | p. 651, LC | pp. 874–875 |
| 9. Binders | p. 26 | ditto | pp. 873–874 |
| 10. Plasticizers, Lubricants | p. 27 | p. 650, RC | p. 876 |
| 11. Coating aids, Surfactants | pp. 26–27 | ditto | p. 875–876 |
| 12. Antistatic agents | p. 27 | ditto | pp. 876–877 |
| 13. Matting agents | | | pp. 878–879 |

Furthermore, the following can be used. The terms "LU", "LL", "RU", and "RL" mean "left upper column", "left lower column", "right upper column", and "right lower column", respectively.

1) Silver halide emulsions and methods for producing them:

JP-A-2-97937, p.20, RL, line 12 to p.21, LL, line 14; JP-A-2-12236, p.7, RU, line 19 to p.8, RL, line 12; JP-A-4-330433; and JP-A-5-11389.

2) Spectral sensitizing dyes:

JP-A-2-55349, p.7, RU, line 8 to p.8, RL, line 8; JP-A-2-39042, p.7, RL, line 8 to p.13, RL, line 5; JP-A-2-12236, p.8, LL, line 13 to RL, line 4; JP-A-2-103536, p.16, RL, line 3 to p.17, LL, line 20; JP-A-1-112235; JP-A-2-124560; JP-A-3-7928; and JP-A-5-11389.

3) Surfactants and antistatic agents:

JP-A-2-12236, p.9, RL, line 7 to RL; and JP-A-2-18542, p.2, LL, line 13 to p.4, RL, line 18.

4) Antifoggants and stabilizers:

JP-A-2-103536, p.17, RL, line 19 to p.18, RU, line 4 and RL, lines 1–5; and JP-A-1-237538 (thiosulfinic acid compounds).

5) Polymer latexes:

JP-A-2-103536, p.18, LL, lines 12 to 20.

6) Compounds having an acid group:

JP-A-2-103536, p.8, RL, line 5 to p.19, LU, line 1; and JP-2-55349, p.8, RL, line 13 to p.11, LU, line 8.

7) Polyhydroxybenzenes:

JP-A-2-55349, p.11, LU, line 9 to RL, line 17.

8) Matting agents, slip agents, and plasticizers:

JP-A-2-103536, p.19, LU, line 15 to RU, line 15.

9) Hardeners:

JP-A-2-103536, p.18, RU, lines 5–17.

10) Dyes:

JP-A-2-103536, p.17, RL, lines 1–18; and JP-A-2-30042, p.4, RU, line 1 to p.6, RU, line 5.

11) Binders:

JP-A-2-18542, p.3, RL, lines 1–20.

12) Developing agents and developing methods:

JP-A-2-55349, p.13, RL, line 1 to p.16, LU, line 10; JP-A-2-103536, p.19, RU, line 16 to p.21, RU, line 8.

13) Black pepper preventives:

U.S. Pat. No. 4,956,257 and JP-A-1-118832.

14) Redox compounds:

JP-A-2-301743 (formula (I), particularly Compound Nos. 1 to 50); JP-A-3-174143, p.3–20 (formulae (R-1), (R-2) and (R-3), Compounds 1 to 75), JP-A-5-257239, and JP-A-4-278939.

15) Monomethine compounds:

JP-A-2-287532 (formula (II), particularly compounds II-1 to II-26).

16) Hydrazine nucleating agents:

JP-A-2-12236, p.2, RU, line 19 to p.7, RU, line 3; and JP-A-3-174143, p.20, RL, line 1 to p.27, RU, line 20 (formula (II) and Compounds II-1 to II-54)

17) Nucleation accelerators:

JP-A-2-103536, p.9, RU, line 13 to p.16, LU, line 10 (formulae (II-m) to (II-p) and Exemplified Compounds II-1 to II-22); and JP-A-1-179939.

Hydrophilic binders are preferably used as the binders for the layers constituting the heat developable light-sensitive material and the complexing agent sheet. Examples thereof include binders described in the above RD's and JP-A-64-13546, pp.71–75. Specifically, transparent or translucent hydrophilic binders are preferred, and examples thereof include natural compounds such as proteins (e.g., gelatin, gelatin derivatives), polysaccharides (e.g., cellulose derivatives, agar, starch, gum arabic, dextran, pullulan, furcellaran, carrageenan described in EP-A-443529, low cast bean gum, xanthan gum and pectin) and polysaccharides described in JP-A-1-221736; and synthetic polymers such as polyvinyl alcohol, modified alkyl polyvinyl alcohols described in JP-A-7-219113, polyvinylpyrrolidone and polyacrylamide. Furthermore, there can also be used high water-absorptive polymers described in U.S. Pat. No. 4,960,681 and JP-A-62-245260, namely homopolymers of vinyl monomers having —COOM or —$SO_3M$ (wherein M represents a hydrogen atom or an alkali metal), or copolymers of these vinyl monomers with each other or with other monomers (e.g., sodium methacrylate, ammonium methacrylate, Sumikagel L5-H produced by Sumitomo Chemical Co, Ltd.). These binders can be used in combination. In particular, combinations of gelatin and the binders are preferred. Gelatin is selected from lime-treated gelatin, acid-treated gelatin and so-called delimed gelatin reduced in content of calcium, depending on various purposes, and they are also preferably used in combination.

When the system of supplying a trace amount of water to conduct heat development is employed, use of the high water-absorptive polymers makes it possible to rapidly absorb water.

In the present invention, the amount of the binders coated is preferably 20 g/$m^2$ or less, more preferably 10 g/$m^2$ or less, and most preferably 7 g/$m^2$ or less.

In the present invention, organic metal salts can also be used as oxidizing agents in combination with the light-sensitive silver halide emulsions. Of these organic metal salts, organic silver salts are particularly preferably used.

Organic compounds which can be used for formation of the organic silver salt oxidizing agents include benzotriazole compounds, fatty acids and other compounds described in U.S. Pat. No. 4,500,626, col.52–53. Silver acetylide described in U.S. Pat. No. 4,775,613 is also useful. The organic silver salts may be used in combination.

The organic silver salt can be used in combination with the light-sensitive silver halide in an amount of 0.01 to 10 mol, preferably 0.01 to 1 mol, per mol of light-sensitive silver halide. The total amounts of the organic silver salt and the light-sensitive silver halide coated are 0.05 to 10 g/$m^2$, preferably 0.1 to 4 g/$m^2$, in terms of silver.

In the present invention, reducing agents known in the field of heat developable light-sensitive material can be used. Furthermore, the reducing agents also include reductive dye-donating compounds given later (in this case, they can be used in combination with other reducing agents).

Examples of the reducing agents for use in the present invention include reducing agents and precursors of reducing agents described in U.S. Pat. Nos. 4,500,626 (col.49–50), 4,839,272, 4,330,617, 4,590,152, 5,017,454 and 5,139,919, JP-A-60-140335 (pp.17–18), JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-244044, JP-A-62-131253, JP-A-62-131256, JP-A-64-13546 (pp.40–57), JP-A-1-120553, and EP-A-220746 (pp.78–96).

Combinations of various reducing agents can also be used as disclosed in U.S. Pat. No. 3,039,869.

When nondiffusion reducing agents are used, electron transfer agents and/or precursors thereof can be used in combination to enhance electron transfer between the nondiffusion reducing agents and the silver halides if necessary. It is particularly preferred to use ones described in U.S. Pat. No. 5,139,919 and EP-A-418743. Furthermore, methods for stably introducing them into layers as described in JP-A-2-230143 and JP-A-2-235044 are preferably used.

The electron transfer agents or the precursors thereof can be selected from the reducing agents or the precursors thereof described above. It is preferred that the electron transfer agents or the precursors thereof are higher in their mobility than the nondiffusion reducing agents (electron donors). Particularly useful electron transfer agents are 1-phenyl-3-pyrazolidone derivatives and aminophenol derivatives.

The nondiffusion reducing agents (electron donors) used in combination with the electron transfer agents may be any of the reducing agents, as long as they do not substantially move in the layers of the light-sensitive material. Preferred examples thereof include hydroquinone derivatives, sulfonamidophenols, sulfonamidonaphthols and compounds described in JP-A-53-110827, U.S. Pat. Nos. 5,032,487, 5,026,634 and 4,839,272 as electron donors.

Furthermore, precursors of electron donors as described in JP-A-3-160443 are also preferably used.

Moreover, for various purposes such as color mixture prevention and improvement in color reproduction, the reducing agents can be used in undercoat layers, antihalation layers, intermediate layers or protective layers. Specifically, reducing agents described in EP-A-524649, EP-A-357040, JP-A-4-249245, JP-A-2-46450 and JP-A-63-186240 are preferably used. Furthermore, reductive compounds releasing development inhibitors as described in JP-B-3-63733, JP-A-1-150135, JP-A-2-46450, JP-A-2-64634, JP-A-3-43735 and EP-A-451833 are also used.

In the present invention, the total amount of the reducing agents added is preferably 0.01 to 20 mol, more preferably 0.1 to 10 mol, per mol of silver.

In the present invention, silver and/or dye is used as an image formation substance. In a silver image, a silver halide in an unexpected area can be excluded to a complexing agent sheet by silver salt diffusion transfer as described in JP-A-62-283332. In such a case, remaining silver on the light-sensitive material and transferred silver on the complexing agent sheet can be used as an image. In order to obtain a dye image, an antidiffusible dye-donating compound is contained in the light-sensitive material, and then the diffusible dye is formed corresponding to or reverse-corresponding to a reduction reaction in which a silver ion (silver halide) is reduced to silver, or the diffusible dye is released and transferred to the complexing agent sheet. Furthermore, an antidiffusible dye is formed corresponding to a development reaction of a silver halide, and an unreacted development agent cab be transferred to the complexing agent sheet. In such a dye image, the transferred dye image formed on the complexing agent sheet can be used. Also, the image on the light-sensitive side can be used as a color negative, optionally by conducting a scanning image processing using a scanner.

Examples of the dye-donating compounds available in the present invention include compounds forming dyes by an oxidation coupling reaction (couplers). The couplers may be either 4-equivalent couplers or 2-equivalent couplers. The nondiffusion groups may be polymer chains. Examples of the color developing agents and the couplers are described in T. H. James, *The Theory of the Photographic Process*, the fourth edition (pp.291–334 and 354–361), JP-A-58-123533, JP-A-58-149046, JP-A-58-149047, JP-A-59-111148, JP-A-124399, JP-A-174835, JP-A-59-231539, JP-A-59-231540, JP-A-60-66249, and Japanese Patent Application Nos. 6-270700, 6-307049 and 6-312380.

As other examples of the dye-donating compounds, nondiffusion dye-donating compounds (thiazolidine compounds) having heterocyclic rings containing nitrogen atoms and sulfur atoms or selenium atoms, the heterocyclic rings being cleaved in the presence of silver ions or soluble silver complexes to release movable dyes as described in JP-A-59-180548, can also be used.

Further examples of the dye-donating compounds include compounds having the function of releasing or diffusing diffusion dyes imagewise. The compounds of this type can be represented by the following formula (L1):

$$((\mathrm{Dye})_m\text{—}\mathrm{Y})_n\text{—}\mathrm{Z} \qquad \text{(L1)}$$

wherein Dye represents a dye group, a dye group temporarily shifted to a short wavelength, or a dye precursor group; Y represents a single bond or a bonding group; Z represents a group having a property of bringing about the difference in diffusibility of the compound represented by $((\mathrm{Dye})_m\text{—}\mathrm{Y})_n\text{—}\mathrm{Z}$ corresponding to or reverse-corresponding to a light-sensitive silver salt having a latent image imagewise, or releasing $(\mathrm{Dye})_m\text{—}\mathrm{Y}$ to produce the difference in diffusibility between $(\mathrm{Dye})_m\text{—}\mathrm{Y}$ released and $((\mathrm{Dye})_m\text{—}\mathrm{Y})_n\text{—}\mathrm{Z}$; m represents an integer of 1 to 5; n represents 1 or 2; and when either m or n is not 1, the plurality of Dye's may be the same or different.

Specific examples of the dye-donating compound represented by formula (LI) include the following compounds (1) to (5). The compounds (1) to (3) release a diffusible dye corresponding to the development of silver halide. The compounds (4) and (5) release a diffusible dye (negative dye image) reverse-corresponding to the development of silver halide.

(1) Dye developing agents in which a hydroquinone developing agent and a dye component are connected to each other can be used as disclosed in U.S. Pat. Nos. 3,134,764, 3,362,819, 3,597,200, 3,544,545, and 3,482,972. These dye developing agents are diffusible under alkaline conditions but react with silver halide to become nondiffusible.

(2) As described in U.S. Pat. No. 4,503,137, nondiffusible compounds can be used which release a diffusible dye under alkaline conditions but react with silver halide to lose its capability. Examples of the nondiffusible compounds include compounds which release a diffusible dye by an intramolecular nucleophilic substitution reaction as disclosed in U.S. Pat. No. 3,980,479, and compounds which release a diffusible dye by an intramolecular rearrangement reaction of isooxazolone rings as disclosed in U.S. Pat. No. 4,199,354.

(3) As disclosed in U.S. Pat. Nos. 4,559,290, and 4,783,396, EP-A-220746, and *JIII Journal of Technical Disclosure* 87–6199, and nondiffusible compounds can be used which react with a reducing agent left unoxidized upon development to release a diffusible dye.

Examples of the nondiffusible compounds include compounds which release a diffusible dye by an intramolecular nucleophilic substitution reaction after reduction as described in U.S. Pat. Nos. 4,139,389, and 4,139,379, JP-A-59-185333 and JP-A-57-84453, compounds which release a diffusible dye by an intramolecular electron migration reaction after reduction as described in U.S. Pat. No. 4,232,107, JP-A-59-101649 and JP-A-61-88257, and RD No. 24025 (1984), compounds which release a diffusible dye by cleaving a single bond after reduction as described in West German Patent 3,008,588A, JP-A-56-142530 and U.S. Pat. Nos. 4,343,893 and 4,619,884, nitro compounds which release a diffusible dye after receiving electrons as described in U.S. Pat. No. 4,450,223, and compounds which release a diffusible dye after receiving electrons as described in U.S. Pat. No. 4,609,610.

(4) Coupler compounds containing a diffusible dye as a leaving group which release a diffusible dye by a reaction with an oxidant of a reducing agent (DDR couplers) can be used. Specific examples thereof are described in British Patent 1330524, JP-B-48-39165, and U.S. Pat. Nos. 3,443,940, 4,474,867 and 4,483,914.

(5) Compounds capable of reducing silver halides or organic silver salts and releasing a diffusible dye by reducing the silver halides or organic silver slats (DRR compounds) can be used. These compounds do not require other reducing agents. Consequently, they are preferred because they are free from stain on the image with an oxidative decomposition product of reducing agents. Examples thereof are described in U.S. Pat. Nos. 3,928,312, 4,053,312, 4,055,428, 4,336,322, 3,725,062, 3,728,113, 3,443,939 and 4,500,626, JP-A-59-65839, JP-A-59-69839, JP-A-53-3819, JP-A-51-104343, JP-A-58-116537 and JP-A-57-179840.

In addition, dye-donating compounds other than the above-described couplers and formula (LI) include dye-silver compounds obtained by an organic silver salt and a dye (RD, pp.54–58 (May 1978)), azo dyes for use in a heat-developable dye bleaching method (U.S. Pat. No. 4,234,957; RD, pp.30–32, (April 1976)), and leuco dyes (U.S. Pat. Nos. 3,985,565 and 4,002,617).

The hydrophobic additives such as the dye-donating compounds and the nondiffusion reducing agents can be introduced into the layers of the heat developable light-sensitive material by known methods such as described in U.S. Pat. No. 2,322,027. In this case, high boiling organic solvents as described in U.S. Pat. Nos. 4,555,470, 4,536,466, 4,536,467, 4,587,206, 4,555,476 and 4,599,296, JP-A-63-306439, JP-A-62-8145, JP-A-62-30247 and JP-B-3-62256 can be used, if necessary, in combination with low boiling organic solvents having a boiling point of 50° to 160° C. Furthermore, these dye-donating compounds, nondiffusion reducing agents and high boiling organic solvents can be used in combination. The amount of the high boiling organic solvents is 10 g or less, preferably 5 g or less, and more preferably 1 g to 0.1 g, per gram of hydrophobic additive to be used. Furthermore, it is 1 ml or less, preferably 0.5 ml or less, and more preferably 0.3 ml or less, per gram of binder.

Furthermore, dispersing methods according to polymerized products described in JP-B-51-39853 and JP-A-51-59943.

The compounds substantially insoluble in water can be dispersed in binders as fine grains to add them to the layers, in addition to the methods.

When the hydrophobic compounds are dispersed in hydrophilic colloids, various surfactants can be used. For example, surfactants described in JP-A-59-157636, pp.37–38, and the above RD's can be used. Furthermore, polymer dispersants may be used.

Furthermore, phosphate surfactants described in JP-A-7-56267, JP-A-7-228589, and West German Patent (OLS) 1,932,299A can also be used.

When dye images are used in combination in the complexing agent sheet, mordants known in the field of photography can be used. Examples thereof include mordants described in U.S. Pat. No. 4,500,626, col.51–52.

Binders for use in the complexing agent sheet of the present invention are preferably the hydrophilic binders described above. Furthermore, it is preferable to use carrageenans as described in EP-A-443,529, polysaccharides such as dextran, and latexes having a glass transition temperature of 40° C. or less as described in JP-B-3-74820, in combination with the binders. Furthermore, mordant polymers known in the field of high water-absorptive polymers or photography may be used in combination. Examples of the mordants are described in U.S. Pat. 4,500,626 (col.58–59), JP-A-61-88256 (pp.32–41), JP-A-1-161236 (pp.4–7), and JP-A-62-244043.

The complexing agent sheet may be provided with supplementary layers such as protective layers, separation layers, undercoat layers, intermediate layers, back layers and curl prevention layers. In particular, it is useful to provide protective layers.

In the layers constituting the heat developable light-sensitive material and the complexing agent sheet, high boiling organic solvents can be used as plasticizers, slipping agents or separation improvers of the complexing agent sheet from the heat developable light-sensitive material. Examples thereof include solvents described in the above RD's and JP-A-62-245253.

Furthermore, various silicone oils (all silicone oils including dimethylsilicone oils and modified silicone oils in which various organic groups are introduced into dimethylsiloxanes) can be used as the agents. Effective examples thereof include various modified silicone oils described in *Modified Silicone Oils*, Technical Data P6–18B, published by Shinetsu Silicone Co., Ltd., particularly carboxy-modified silicone (trade name: X-22-3710).

Furthermore, silicone oils described in JP-A-62-215953 and JP-A-63-46449 are also effective.

Antifading agents may be used in the light-sensitive material and the complexing agent sheet. The antifading agents include antioxidants, ultraviolet absorbing agents and some kinds of metal complexes.

Examples of the antioxidants include chroman compounds, coumaran compounds, phenol compounds (e.g., hindered phenols), hydroquinone derivatives, hindered amine derivatives and spiroindan compounds. Compounds described in JP-A-61-159644 are also effective.

The ultraviolet absorbing agents include benzotriazole compounds (e.g., U.S. Pat. No. 3,533,794), 4-thiazolidone compounds (e.g., U.S. Pat. No. 3,352,681), benzophenone compounds (e.g., JP-A-46-2784) and other compounds described in JP-A-54-48535, JP-A-62-136641 and JP-A-61-88256. Ultraviolet absorbing polymers described in JP-A-62-260152 are also effective.

The metal complexes include compounds described in, e.g., U.S. Pat. Nos. 4,241,155, 4,245,018 (col.3–35) and 4,254,195 (col.3–8), JP-A-62-174741, JP-A-61-88256 (pp.27–29), JP-A-63-199248, JP-A-1-75568, JP-A-1-74272.

The antioxidants, ultraviolet absorbing agents and metal complexes may be used as combinations of them.

Fluorescent brightening agents may be used in the light-sensitive material and the complexing agent sheet. Examples thereof include compounds described in, e.g., *The Chemistry of Synthetic Dyes*, Vol. V, Chapter 8, edited by K. Veenkataraman, JP-A-61-143752. More specifically, they include stilbene compounds, coumarin compounds, biphenyl compounds, benzoxazolyl compounds, naphthalimide compounds, pyrazoline compounds and carbostyril compounds.

The fluorescent brightening agents can be used in combination with the antifading agents or the ultraviolet absorbing agents.

Specific examples of these antifading agents, ultraviolet absorbing agents and fluorescent brightening agents are described in JP-A-62-215272 (pp.125–137), and JP-A-1-161236 (pp.17–43).

Hardeners for use in the layers constituting the heat developable light-sensitive material and the complexing agent sheet include hardeners described in the above RD's, U.S. Pat. Nos. 4,678,739, col.41, and 4,791,042, JP-A-59-116655, JP-A-62-245261, JP-A-61-18942 and JP-A-4-218044. More specifically, examples thereof include aldehyde hardeners (e.g., formaldehyde), aziridine hardeners, epoxy hardeners, vinylsulfone hardeners (e.g., N,N'-ethylene-bis(vinylsulfonylacetamido)ethane), N-methylol hardeners (dimethylolurea) and polymer hardeners (compounds described in JP-A-62-234157).

These hardeners are used in an amount of 0.001 to 1 g, preferably 0.005 to 0.5 g, per gram of hydrophilic binder coated. They may be added to any of the layers constituting the light-sensitive material and the complexing agent sheet, and may be divided to add them to two or more layers.

In the layers constituting the heat developable light-sensitive material and the complexing agent sheet, various antifoggants or photographic stabilizers and precursors thereof can be used. Examples thereof include compounds described in the above RD's, U.S. Pat. Nos. 5,089,378, 4,500,627 and 4,614,702, JP-A-64-13546 (pp.7–9, 57–71 and 81–97), U.S. Pat. Nos. 4,775,610, 4,626,500 and 4,983,494, JP-A-62-174747, JP-A-62-239148, JP-A-63-264747, JP-A-1-150135, JP-A-2-110557, JP-A-2-178650, JP-A-8-54705, and RD, 17643 (1978).

These compounds are preferably used in an amount of from $5\times10^{-6}$ to 10 mol, preferably from $1\times10^{-5}$ to 1 mol, per mol of silver.

In the layers constituting the heat developable light-sensitive material and the complexing agent sheet, various surfactants can be used for assisting coating, improving separation, improving slipperiness, preventing electric charge, and accelerating development. Examples of the surfactants are described in the above RD's, JP-A-62-173463 and JP-A-62-183457.

The layers constituting the heat developable light-sensitive material and the complexing agent sheet may contain organic fluoro compounds for improving slipperiness, preventing electric charge and improving separation. Examples of the organic fluoro compounds include fluorine surfactants described in JP-B-57-9053, col.8–17, JP-A-61-20944 and JP-A-62-135826, and hydrophobic fluorine compounds such as oily fluorine compounds (e.g., fluorine oils) and solid fluorine compounds (e.g., ethylene tetrafluoride resins).

The heat developable light-sensitive material and the complexing agent sheet can contain matte agents for preventing adhesion, improving slipperiness and delustering surfaces of the light-sensitive material and the complexing agent sheet. The matte agents include compounds such as benzoguanamine resin beads, polycarbonate resin beads and AS resin beads described in JP-A-63-274944 and JP-A-63-274952, as well as compounds such as silicon dioxide, polyolefins and polymethacrylates described in JP-A-61-88256 (p.29). In addition, compounds described in the above RD's can be used. These matte agents can be added not only to the uppermost layers (protective layers), but also to lower layers as needed.

Besides, the layers constituting the heat developable light-sensitive material and the complexing agent sheet may contain heat solvents, antifoaming agents, microbicidal antifungal agents and colloidal silica. Examples of these additives are described in JP-A-61-88256 (pp.26–32), JP-A-3-11338 and JP-B-2-51496.

In the present invention, image formation accelerating agents can be used in the heat developable light-sensitive material and/or the complexing agent sheet. The image formation accelerating agents can be classified into bases or base precursors, nucleophilic compounds, high boiling organic solvents (oils), heat solvents, surfactants, compounds having interaction with silver or silver ions according to the physicochemical functions. However, these groups of substances generally have combined functions, and therefore, they have usually combinations of some of the accelerating effects. The details thereof are described in U.S. Pat. No. 4,678,739 (col.38–40).

In the present invention, various development stoppers can be used in the heat developable light-sensitive material and/or the complexing agent sheet for obtaining always constant images against fluctuations in processing temperature and processing time on development.

The development stopper as used herein is a compound which, after normal development, rapidly neutralizes or reacts with a base to reduce the concentration of the base contained in a film, thereby stopping development, or a compound which interacts with silver and a silver salt to inhibit development. Examples thereof include acid precursors releasing acids by heating, electrophilic compounds which conduct replacement reaction with coexisting bases by heating, nitrogen-containing heterocyclic compounds, mercapto compounds and precursors thereof. More specifically, they are described in JP-A-62-253159 (pp.31–32).

In the present invention, supports which can endure processing temperatures are used as supports employed in the heat developable light-sensitive material and the complexing agent sheet. In general, the supports include photographic supports such as paper and synthetic polymers (films) described in *Shashin Kohgaku no Kiso* (*Higinen Shashin*) (The Fundamentals of Photographic Engineering (Nonsilver Photograph)), pp.223–240, edited by Nippon Shashin Gakkai, Corona Publishing Co. Ltd. (1979). Specific examples include polyethylene terephthalate, polyethylene naphthalate, polycarbonates, polyvinyl chloride, polystyrene, polypropylene, polyimides, polyarylates, cellulose derivatives (e.g., cellulose triacetate), films thereof containing pigments such as titanium oxide, synthetic paper produced from propylene by film methods, mixed paper produced from pulp of synthetic resins such as polyethylene and natural pulp, Yankee paper, baryta paper, coated paper (particularly, cast-coated paper), metals, cloth, or glass.

They can be used alone or as supports coated with synthetic polymers such as polyethylene on one side or both sides. The laminated layers can contain pigments such as titanium oxide, ultramarine and carbon black or dyes if necessary.

In addition, supports described in JP-A-62-253159 (pp.29–31), JP-A-1-161236 (pp.14–17), JP-A-63-316848, JP-A-2-22651, JP-A-3-56955 and U.S. Pat. No. 5,001,033 can be used.

Back surfaces of these supports may be coated with hydrophilic binders and semiconductive metal oxides such as alumina sols and tin oxide, or with antistatic agents such as carbon black.

The thickness of the support can be selected according to the purpose, and if coatability and transportability are considered, it is preferably from 20 to 300 μm.

For improving adhesion to the hydrophilic binders, various surface treatments or undercoating treatments are preferably applied to surfaces of the supports.

In particular, when requirements for heat resistance or curling characteristics are severe, supports described in JP-A-6-41281, JP-A-6-43581, JP-A-6-51426, JP-A-6-51437, JP-A-6-51442, JP-A-6-82961, JP-A-6-82960, JP-A-6-82959, JP-A-6-67346, JP-A-6-202277, JP-A-6-175282, JP-A-6-118561, JP-A-7-219129, and JP-A-7-219144 can be used as the supports for the light-sensitive material.

Methods for exposing the heat developable light-sensitive material to record images include, for example, methods of directly taking landscape photographs or human subject photographs by use of cameras, methods of exposing the light-sensitive material through reversal films or negative films by use of printers, enlargers, methods of subjecting original pictures to scanning exposure through slits by use of exposing devices of copying machines, methods of allowing light emitting diodes, various lasers (such as laser diodes and gas lasers) to emit light by image information through electric signals to subject the light-sensitive material to scanning exposure (methods described in JP-A-2-129625), and methods of supplying image information to image displays such as CRTs, liquid crystal displays, electroluminescence displays and plasma displays to expose the light-sensitive material directly or through optical systems.

As described above, light sources and exposing methods such as natural light, tungsten lamps, light emitting diodes, laser sources and CRT light sources described in U.S. Pat. No. 4,500,626, col.56, JP-A-2-53378 and JP-A-2-54672 can be used to record images on the heat developable light-sensitive material.

Light sources can be used in which blue light emitting diodes recently remarkably developed are combined with green light emitting diodes and red light emitting diodes. In particular, exposing devices described in Japanese Patent Application Nos. 6-40164, 6-40012, 6-42732, 6-86919, 6-93421, 6-94820, 6-96628 and 6-149609 can be preferably used.

In particular, He-Ne lasers, Ar lasers, infrared and visible semiconductor lasers are used in color scanners and image setters in the printing field, and particularly, infrared semiconductor lasers can be preferably used which themselves are compact, have long life, is inexpensive and can be directly modulated.

There can be used the DC series of Linotype-Hell Co. and the Magnascan series of Crosfield Co. which are commercially available Ar laser exposure units, the SG series of Dainippon Screen Mfg. Co. Ltd. which is commercially available He-Ne laser exposure units, LuxScan of Fuji Photo Film Co. Ltd. which is commercially available semiconductor laser exposure units, color scanners such as MTR of Dainippon Screen Mfg. Co. Ltd., image setters such as Selectset (He-Ne) and Avantra (Red-LD) of AGFA-Gevaert, N. V., Herkules (Red-LD) of Linotype-Hell Co., Dolev (He-Ne) of Scitex Co., Accuser (Red-LD) of AGFA-Gevaert, N. V. and LuxSetter 5600 of Fuji Photo Film Co. Ltd., and exposure units for facsimile such as FT-240R of NEC Corp.

Furthermore, images can also be exposed using wavelength converting elements in which non-linear optical material are combined with coherent light sources such as laser beams. Here, the non-linear optical material is a material which can express non-linearity between an electrical field and polarization appearing when a strong optical electrical field such as a laser beam is given. Preferable examples of the materials include inorganic compounds represented by lithium niobate, potassium dihydrogenphosphate (KDP), lithium iodate and $BaB_2O_4$, urea derivatives, nitroaniline derivatives, nitropyridine-N-oxide derivatives such as 3-methyl-4-nitropyridine-N-oxide (POM), and compounds described in JP-A-61-53462 and JP-A-62-210432. As the forms of the wavelength converting elements, the single crystal optical waveguide path type and the fiber type are known, and both are useful.

Furthermore, as the image information, there can be utilized image signals obtained from video cameras or electronic still cameras, television signals represented by the Nippon Television Signal Criteria (NTSC), image signals obtained by dividing original pictures into many picture elements with scanners and image signals produced by use of computers represented by CG and CAD.

The image formation method of the present invention can be used for various applications. It can be applied, for example, to taking color negative or color positive materials, positive type or negative type color print materials or black-and-white print materials, materials for plate making such as lithographic light-sensitive materials or RAS light-sensitive materials, X-ray light-sensitive materials or press plate materials. When applied to the press plate materials, it can be combined with lipophilization treatment as described in Japanese Patent Application Nos. 7-137450 and 7-137510.

The image formation method of the present invention can also be applied to color negative materials for digital processing. Specifically, it can also be applied to photographing materials forming color development or silver images conforming to spectral sensitivity of scanners described in JP-A-6-266066, JP-A-6-266065, JP-A-6-67373, EP-A-610944, EP-A-599428 and EP-A-526931.

Furthermore, when used as photographing materials, it is preferred that the supports of the present invention are coated with magnetic layers described in JP-A-4-124645, JP-A-5-40321, JP-A-6-35092, JP-A-6-317875, and Japanese Patent Application Nos. 5-58221 to record taking information.

The light-sensitive material and/or the complexing agent sheet for use in the present invention may have conductive heating layers as heating means for heat development and diffusion transfer of silver salts. In this case, heating elements described in JP-A-61-145544 can be utilized.

In the present invention, it is preferred that heating carried out in the presence of a trace amount of water to conduct development and transfer at the same time as described in U.S. Pat. Nos. 4,704,345 and 4,740,445, and JP-A-61-238056. In this system, the heating temperature is preferably 50° C. to 100° C.

In the present invention, any water may be used as long as it is generally used. For example, distilled water, tap water, well water, or mineral water can be used. In heat developing equipment in which the light-sensitive material and the complexing agent sheet are processed, water may be used in the disposable form, or repeatedly circulated. The latter case results in use of water containing components eluted from the light-sensitive material. Furthermore, equipment and water described in JP-A-63-144354, JP-A-63-144355, JP-A-62-38460, or JP-A-3-210555 may be used. Furthermore, water may contain water-soluble low boiling solvents, surfactants, antifoggants, complex forming compounds with slightly soluble metal salts, antifungal agents or microbiocides.

Water can be given to the light-sensitive material or the complexing agent sheet or both, but preferably given to the light-sensitive material. The amount used may be the same or less than the water amount corresponding to the maximum swelled volume. Specifically, it is from 1 to 30 g/m$^2$, and preferably from 1 to 20 g/m$^2$.

Preferred examples of methods for giving water include methods described in JP-A-62-253159 (p.5), and JP-A-63-85544. Furthermore, solvents enclosed in microcapsules or hydrated can be previously contained in the heat developable light-sensitive material or dye fixing elements or both thereof.

The temperature of water to be given may be 30° C. to 60° C. as described in JP-A-63-85544. In particular, in order to prevent bacteria in water from propagating, it is useful to keep the temperature of water at 45° C. or more.

Hydrophilic heat solvents which are solid at ordinary temperature and soluble at high temperatures can be contained in the light-sensitive material and/or the complexing agent sheet. The solvents may be contained in any of the light-sensitive silver halide emulsion layers, the intermediate layers and the protective layers of the light-sensitive material, and any layers of the complexing agent sheet.

Examples of hydrophilic heat solvents include urea derivatives, pyridine derivatives, amides, sulfonamides, imides, alcohols, oximes and other heterocyclic compounds.

Heating methods in the development and/or transfer stage include methods of bringing the light-sensitive material and the complexing agent sheet into contact with heated blocks, heated plates, hot pressers, heat rolls, heat drums, halogen lamp heaters, infrared or far infrared lamp heaters, and methods of passing them through atmospheres of high temperatures.

The heat developable light-sensitive material and the complexing agent sheet can be placed one over the other by methods described in JP-A-62-253159 and JP-A-61-147244 (p.27).

Any of various heat development devices can be used for processing the light-sensitive elements in the present invention. For example, devices described in JP-A-59-75247, JP-A-59-177547, JP-A-59-181353, JP-A-60-18951, and JU-A-62-25994 (the term "JU-A" as used herein means an "unexamined published Japanese utility model application") are preferably used. As commercially available devices, there can be used Pictrostat 100, Pictrostat 200, Pictrostat 300, Pictrostat 50, Pictrography 3000 and Pictrography 2000 produced by Fuji Photo Film Co., Ltd.

The present invention is now illustrated in greater detail by way of the following examples, but it should be understood that the present invention is not to be construed as being limited thereto.

EXAMPLE 1

(1) Coating of Polymer and Back Layers

One surface of a polyethylene terephthalate support undercoated with gelatin on both surfaces thereof and having a thickness of 100 μm was coated with the following back layer and polymer layer at the same time in this order from the side near to the support, and dried at 180° C. for 5 minutes.

| (a) Formulation of Back Layer: | |
|---|---|
| Gelatin | 1.6 g/m$^2$ |
| Fine Polymethyl Methacrylate Grains (mean grain size: 3 μm) | 27 mg/m$^2$ |
| Sodium Dodecylbenzenesulfonate | 5 mg/m$^2$ |
| Sodium Polystyrenesulfonate | 10 mg/mm$^2$ |
| N,N'Ethylenebis-(vinylsulfonacetamide) | 21 mg/m$^2$ |
| Ethyl Acrylate Latex (mean grain size: 0.1 μm) | 0.5 g/m$^2$ |
| **(b) Formulation of Polymer layer** | |
| Binder (Methyl methacrylate)$_{62}$-(styrene)$_{11}$ (2-ethylhexyl acrylate)$_{27}$ | 1.2 g/m$^2$ |
| Fine Polymethyl Methacrylate Grains (mean grain size: 3 μm) | 10 mg/m$^2$ |
| $C_8F_{17}SO_3K$ | 5 mg/m$^2$ |
| (Distilled water was used as a solvent for each coating solution) | |

(2) Preparation of Light-sensitive materials

Twenty grams of gelatin and 3 g of sodium chloride are dissolved in 650 ml of water at 40° C. with stirring. After complete dissolution, 15 ml of a 0.1% solution of compound (A) in methanol is added. The resulting solution is stirred, and a solution of silver nitrate (obtained by adding water to 100 g of $AgNO_3$ to bring the volume to 600 ml) is added thereto for 5 minutes while maintaining the temperature at 40° C. After an elapse of 20 seconds from the start of addition of the silver nitrate solution, a halide solution (obtained by adding water to 34.4 g of NaCl to bring the volume to 600 ml) is added for 4 minutes and 40 seconds. After the end of addition, the solution is maintained at 40° C. for 20 minutes, followed by addition of 680 ml of water, 15 ml of 1N sulfuric acid and 15 ml of a 1% aqueous solution of precipitant (1). At this time, the pH of the solution is about 4.0. After precipitation of silver halide grains, 2200 ml of a supernatant is removed to eliminate a salt. Then, 2000 ml of water is further added, and 2200 ml of a supernatant is similarly removed. To the resulting solution, 22 g of gelatin, 2 ml of 1N NaOH and 4 ml of a 10% aqueous solution of NaCl are added, and 70 mg of preservative (1) is further added to obtain a silver chloride emulsion. The pH of this silver chloride emulsion is 6.0, and the yield thereof is about 600 g.

Compound (A)

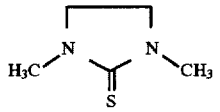

Precipitant (1)

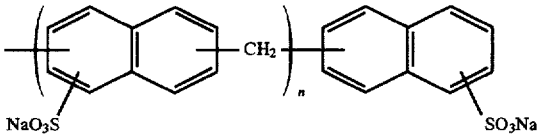

n = 3–4

Preservative (1)

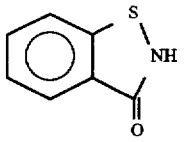

Then, the preparation method of a dispersion of a reducing agent, 1,5-diphenyl-3-pyrazolidone, is described.

Ten grams of 1,5-diphenyl-3-pyrazolidone, 0.1 g of surfactant (1) and 0.5 g of surfactant (2) were added to 90 ml of a 3% aqueous solution of lime-treated gelatin, and dispersed for 30 minutes by use of glass beads having a mean grain size of 0.75 mm. The glass beads were separated to obtain a gelatin dispersion of the reducing agent.

Gelatin dispersions of antihalation dye (1), stabilizer precursor (1) and zinc hydroxide were also prepared according to methods based on this method.

Surfactant (1)

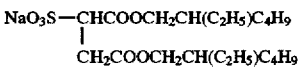

Surfactant (2)

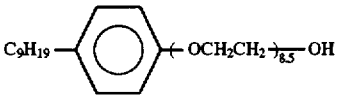

Antihalation Dye (1)

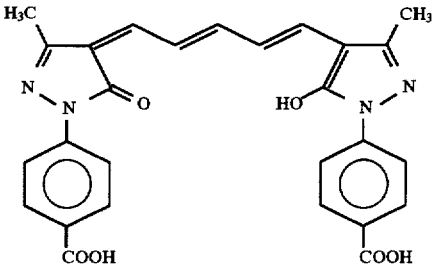

Stabilizer Precursor (1)

Zinc Thiosalicylate

Using the above, light-sensitive material 101 shown in Table 1 was prepared.

TABLE 1

CONSTITUTION OF Light-sensitive material 101

| Layer No. | Layer Name | Additive | Amount Coated (mg/m²) |
|---|---|---|---|
| 4th Layer | Protective layer | Acid-Treated Gelatin | 252 |
| | | PMMA Latex (size: 3 μm) | 12 |
| | | Surfactant (3) | 2 |
| | | Surfactant (1) | 18 |
| | | Sumikagel L5-H (produced by Sumitomo Chemical Co., Ltd.) | 130 |
| 3rd Layer | Emulsion Layer | Light-sensitive Silver Halide Emulsion | 1420 (in terms of silver) |
| | | Lime-Treated Gelatin | 920 |
| | | Sensitizing Dye (1) | 7 |
| | | Sensitizer Dye (2) | 2 |
| | | Surfactant (4) | 32 |
| | | Water-Soluble Polymer (1) | 36 |
| 2nd Layer | Intermediate Layer | Lime-Treated Gelatin | 825 |
| | | 1,5-Diphenyl-3-pyrazolidone | 1650 |
| | | Dextran | 86 |
| | | Hardener (1) | 24 |
| | | Surfactant (1) | 20 |
| | | Surfactant (2) | 95 |
| | | Water-Soluble Polymer (1) | 22 |
| | | Antihalation Dye (1) | 150 |
| 1st Layer | Base Generation Layer | Lime-Treated Gelatin | 263 |
| | | Zinc Hydroxide | 900 |
| | | Surfactant (1) | 5 |
| | | Dextran | 16 |
| | | Water-Soluble Polymer (1) | 6 |
| | | Surfactant (2) | 25 |
| | | Stabilizer Precursor (1) | 70 |

Support (thickness: 100 μm)
Back Layer
Polymer Layer
Surfactant (3)

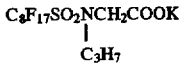

Surfactant (4)

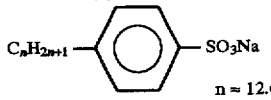

Sensitizing Dye (1)

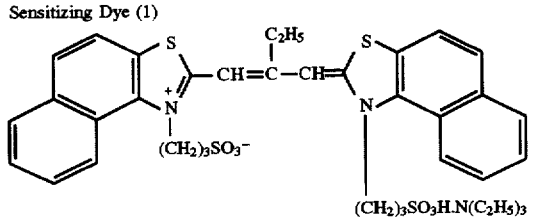

TABLE 1-continued

Sensitizing Dye (2)

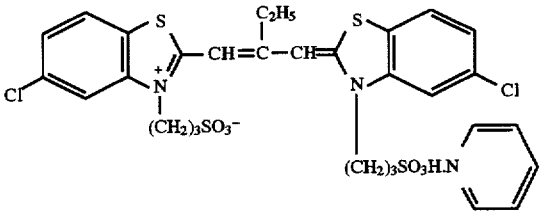

Water-Soluble Polymer (1)

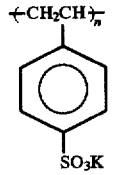

Hardener (1)

$CH_2=CHSO_2CH_2SO_2CH=CH_2$

Then, light-sensitive materials 102 to 106 having the same composition as that of light-sensitive material 101 with the exception that the antihalation dye (1) was substituted by combinations of leuco dyes and color developers shown Table 2 were prepared. Furthermore, light-sensitive material 107 was prepared in which antihalation dye (1) was eliminated from light-sensitive material 101.

The dye compositions were prepared as emulsified dispersions in the following manner, and added.

The leuco dye, the color developer and a high boiling organic solvent if necessary were weighed, and ethyl acetate was added thereto, followed by heat dissolution at about 60° C. to form a homogeneous solution. To 100 ml of this solution, 0.8 g of surfactant (4) and 160 ml of a 5% aqueous solution of lime-treated gelatin heated at about 60° C. were added, and dispersed with a homogenizer at 10000 ppm for 10 minutes.

TABLE 2

| Light-sensitive Material No. | Amount Added (mg/m²) Leuco Dye | Color Developer | High Boiling Solvent | Light-sensitive material D max | D min | Sharpness | Complexing Agent Sheet D max | D min | Sharpness |
|---|---|---|---|---|---|---|---|---|---|
| 101 | — | — | — | 3.54 | 0.16 | Good | 3.78 | 0.88 | Dye was transferred |
| 102 | (27) 280 | (1) 650 | (1) 300 | 3.62 | 0.20 | Good | 3.70 | 0.07 | Good |
| 103 | (1) 260 | (2) 800 | (1) 100 | 3.65 | 0.19 | Good | 3.88 | 0.07 | Good |
| 104 | (27) 300 | (2) 780 | — | 3.59 | 0.18 | Good | 3.69 | 0.07 | Good |
| 105 | (33) 280 | (4) 930 | (2) 100 | 3.60 | 0.18 | Good | 3.67 | 0.07 | Good |
| 106 | (28) 400 | (11) 960 | — | 3.69 | 0.20 | Good | 3.74 | 0.07 | Good |
| 107 | — | — | — | 3.49 | 0.15 | Insufficient | 3.66 | 0.07 | Insufficient |

High boiling solvent: (1) tricresyl phosphate, (2) dibutyl phthalate

Then, complexing agent sheet R1 having the constitution as shown in Table 3 was prepared.

TABLE 3

CONSTITUTION OF COMPLEXING AGENT-CONTAINING SHEET R1

| Layer No. (mg/m²) | Additive | Amount Coated |
|---|---|---|
| 3rd Layer | Gelatin | 250 |
| | Sumikagel L5-H | 10 |
| | Surfactant (5) | 27 |
| | Hardener (2) | 48 |
| | Palladium Sulfide (grain size: 0.02 μm) | 2 |
| 2nd Layer | Gelatin | 800 |
| | Sumikagel L5-H | 240 |
| | Dextran | 660 |
| | Polymer Dispersion (Nipol LX814 produced by Nippon Zeon Co., Ltd.) | 600 |
| | Polyvinylimidazole | 1600 |
| | Surfactant (3) | 10 |
| | Guanidine Picolinate | 2300 |
| | Hydantoin | 534 |
| 1st Layer | Gelatin | 150 |
| | Sumikagel L5-H | 40 |
| | Surfactant (3) | 6 |
| | Surfactant (5) | 27 |

Support Paper Support Laminated with Polyethylene (thickness: 120 μm)

Surfactant (5)

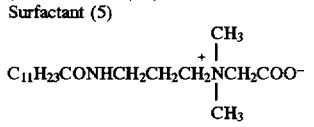

Hardener (2)

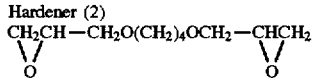

Light-sensitive materials 101 to 107 were each subjected to imagewise exposure, followed by immersion in water maintained at 40° C. for 2.5 seconds. Then, each light-sensitive material was squeezed with rolls, and immediately, the complexing agent sheet was placed thereon so that a film surface thereof comes into contact with the complexing agent sheet. Subsequently, each light-sensitive material was heated for 17 seconds by use of a heat drum adjusted to such a temperature that the temperature of the water-absorbed film surface was elevated to 80° C. When the complexing agent sheet was peeled off, a transmission black-and-white negative image was obtained on the light-sensitive material side, and a reflection black-and-white positive image was obtained on the complexing agent sheet side. The visual densities of the resulting black-and-white images was measured by use of an X-Rite densitometer. Results thereof are shown in Table 2. Further examination of elution of the dyes in processing solutions showed purple elution for light-sensitive material 101, but no elution for the other light-sensitive materials. The results revealed that the dye compositions of the present invention were excellent in antihalation effect, decolorized by development processing, and not eluted in water.

EXAMPLE 2

The preparation method of dispersions of hydrophobic additives such as dye-donating compounds (couplers) in gelatin is described.

Oil phase components and aqueous phase components having compositions shown in Table 4 are each dissolved to prepare homogeneous solutions having a temperature of 60° C. The oil phase components were combined with the aqueous phase components, and the mixture was dispersed in a 1-liter stainless steel vessel with a dissolver equipped with a disperser having a diameter of 5 cm, at 10000 rpm for 20 minutes. Hot water was added thereto as post-added water in amounts shown in Table 4, and mixed at 2000 rpm for 10 minutes. Thus, emulsified dispersions of three color (cyan, magenta and yellow) couplers were prepared.

TABLE 4

| | Cyan | Magenta | Yellow | For Reducing Agent (1) |
|---|---|---|---|---|
| Oil Phase | | | | |
| Cyan Coupler (1) | 4.64 g | — | — | — |
| Magenta Coupler (2) | — | 5.98 g | — | — |
| Yellow Coupler (3) | — | — | 5.56 g | — |
| Reducing Agent (1) | — | — | — | 6.30 g |
| Reducing Agent (Developing Agent) (2) | 3.36 g | 3.36 g | 3.36 g | — |
| Antifoggant (1) | 0.02 g | — | 0.02 g | — |
| High Boiling Solvent (1) | — | — | 1.67 g | — |
| High Boiling Solvent (2) | 0.59 g | 0.75 g | 2.22 g | — |
| High Boiling Solvent (3) | 1.73 g | 2.25 g | — | 2.67 g |
| Ethyl Acetate | 24 ml | 24 ml | 24 ml | 15 ml |
| Aqueous Phase | | | | |
| Lime-Treated Gelatin | 5.0 g | 5.0 g | 5.0 g | 5.0 g |
| Surfactant (4) | 0.4 g | 0.4 g | 0.4 g | 0.4 g |
| Water | 75 ml | 75 ml | 75 ml | 75 ml |
| Post-Added Water | 60 ml | 60 ml | 60 ml | 60 ml |

TABLE 4-continued

| | Cyan | Magenta | Yellow | For Reducing Agent (1) |
|---|---|---|---|---|

Cyan Coupler (1)

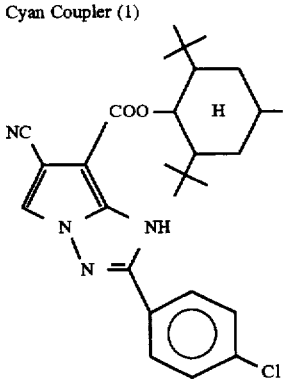

Magenta Coupler (2)

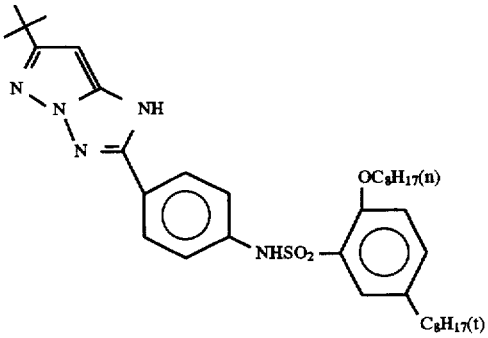

Yellow Coupler (3)

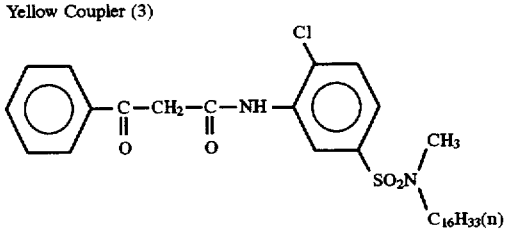

Reducing Agent (1)

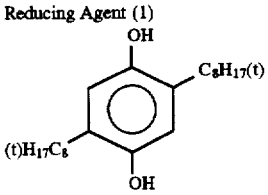

Reducing Agent (Developing Agent) (2)

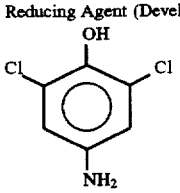

Antifoggant (1)

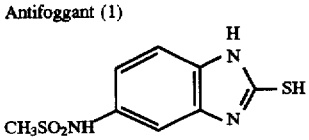

TABLE 4-continued

| | Cyan | Magenta | Yellow | For Reducing Agent (1) |
|---|---|---|---|---|

High Boiling Solvent (1)

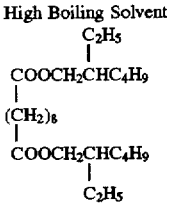

High Boiling Solvent (2)

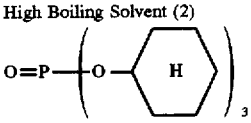

High Boiling Solvent (3)

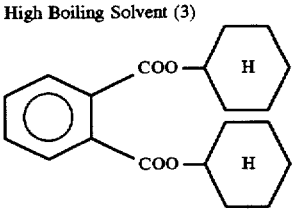

Then, methods for preparing light-sensitive silver halide emulsions are described.

Light-sensitive Silver Halide Emulsion (1) (for Red-Sensitive Emulsion Layer)

Solution (I) and solution (II) shown in Table 5 were concurrently added to an aqueous solution of gelatin well stirred (which was prepared by adding 20 g of gelatin, 0.5 g of potassium bromide, 3 g of sodium chloride and 30 mg of compound (A) to 480 ml of water and maintained at 45° C.) at the same flow rate for 20 minutes. After 5 minutes, solution (III) and solution (IV) shown in Table 5 were further concurrently added thereto at the same flow rate for 25 minutes. Furthermore, from 10 minutes after initiation of addition of solutions (III) and (IV), an aqueous solution of a dye dispersion in gelatin (which contained 1 g of gelatin, 67 mg of sensitizing dye (a), 133 mg of sensitizing dye (b) and 4 mg of sensitizing dye (c) in 105 ml of water and was maintained at 45° C.) was added thereto for 20 minutes.

After normal washing and salt removal, 22 g of lime-treated ossein gelatin was added to adjust the pH to 6.2 and the pAg to 7.7. Then, sodium thiosulfate, 4-hydroxy-6-methyl-1,3,3a,7-tetrazaindene and chloroauric acid were added thereto, and chemical sensitization was optimally conducted at 60° C. Thus, 635 g of a monodisperse cubic silver bromide emulsion having a mean grain size of 30 μm was obtained.

TABLE 5

| | Solution (I) | Solution (II) | Solution (III) | Solution (IV) |
|---|---|---|---|---|
| $AgNO_3$ | 50.0 g | — | 50.0 g | — |
| $NH_4NO_3$ | 0.19 g | — | 0.19 g | — |
| KBr | — | 28.0 g | — | 35.0 g |
| NaCl | — | 3.45 g | — | — |
| | Water to make 250 ml | Water to make 250 ml | Water to make 200 ml | Water to make 200 ml |

TABLE 5-continued

| | Solution (I) | Solution (II) | Solution (III) | Solution (IV) |
|---|---|---|---|---|

Sensitizing Dye (a)

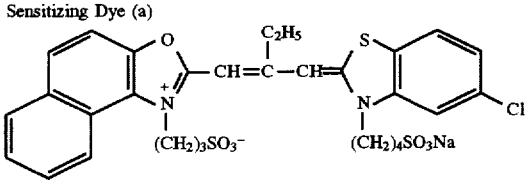

Sensitizing Dye (b)

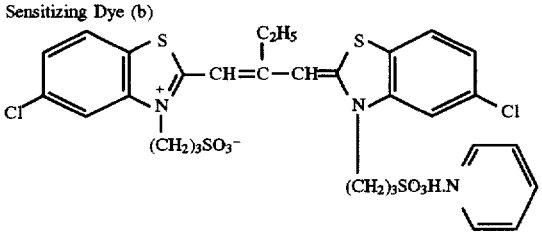

Sensitizing Dye (c)

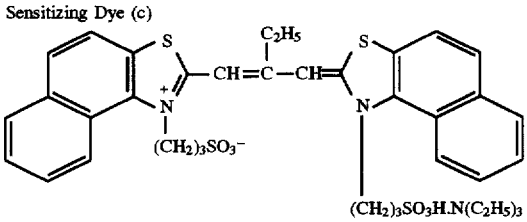

Light-Sensitive Silver Halide Emulsion (2) (for Red-Sensitive Emulsion Layer)

Solution (I) and solution (II) shown in Table 6 were concurrently added to an aqueous solution of gelatin well stirred (which was prepared by adding 20 g of gelatin, 0.5 g of potassium bromide, 6 g of sodium chloride and 30 mg of compound (A) to 783 ml of water and maintained at 65° C.) at the same flow rate for 30 minutes. After 5 minutes, solution (III) and solution (IV) shown in Table 6 were further concurrently added thereto at the same flow rate for 15 minutes. Furthermore, from 2 minutes after initiation of addition of solutions (III) and (IV), an aqueous solution of a dye dispersion in gelatin (which contained 0.9 g of gelatin, 61 mg of sensitizing dye (a), 121 mg of sensitizing dye (b) and 4 mg of sensitizing dye (c) in 95 ml of water and was maintained at 50° C.) was added thereto for 18 minutes.

After normal washing and salt removal, 22 g of lime-treated ossein gelatin was added to adjust the pH to 6.2 and the pAg to 7.7. Then, sodium thiosulfate, 4-hydroxy-6-methyl- 1,3,3a,7-tetrazaindene and chloroauric acid were added thereto, and chemical sensitization was optimally conducted at 60° C. Thus, 635 g of a monodisperse cubic silver chlorobromide emulation having a mean grain size of 50 μm was obtained.

TABLE 6

| | Solution (I) | Solution (II) | Solution (III) | Solution (IV) |
|---|---|---|---|---|
| $AgNO_3$ | 50.0 g | — | 50.0 g | — |
| $NH_4NO_3$ | 0.19 g | — | 0.19 g | — |
| KBr | — | 28.0 g | — | 35.0 g |
| NaCl | — | 3.43 g | — | — |
| | Water to make 200 ml | Water to make 140 ml | Water to make 145 ml | Water to make 155 ml |

Light-sensitive Silver Halide Emulsion (3) (for Green-Sensitive Emulsion Layer)

Solution (I) and solution (II) shown in Table 7 were concurrently added to an aqueous solution of gelatin well stirred (which was prepared by adding 20 g of gelatin, 0.5 g of potassium bromide, 4 g of sodium chloride and 15 mg of compound (A) to 675 ml of water and maintained at 48° C.) at the same flow rate for 10 minutes. After 10 minutes, solution (III) and solution (IV) shown in Table 7 were further concurrently added thereto at the same flow rate for 20 minutes. Furthermore, 1 minute after termination of addition of solutions (III) and (IV), an aqueous solution of a dye dispersion in gelatin (which contained 3.0 g of gelatin and 300 mg of sensitizing dye (d) in 120 ml of water and was maintained at 45° C.) was collectively added thereto.

After normal washing and salt removal, 20 g of lime-treated ossein gelatin was added to adjust the pH to 6.0 and the pAg to 7.6. Then, sodium thiosulfate, 4-hydroxy-6-methyl-1,3,3a,7-tetrazaindene and chloroauric acid were added thereto, and chemical sensitization was optimally conducted at 68° C. Thus, 635 g of a monodisperse cubic silver chlorobromide emulsion having a mean grain size of 0.27 μm was obtained.

TABLE 7

| | Solution (I) | Solution (II) | Solution (III) | Solution (IV) |
|---|---|---|---|---|
| $AgNO_3$ | 50.0 g | — | 50.0 g | — |
| $NH_4NO_3$ | 0.25 g | — | 0.25 g | — |
| KBr | — | 21.0 g | — | 28.0 g |
| NaCl | — | 6.90 g | — | 3.45 g |
| | Water to make 200 ml | Water to make 150 ml | Water to make 200 ml | Water to make 150 ml |

Sensitizing Dye (d)

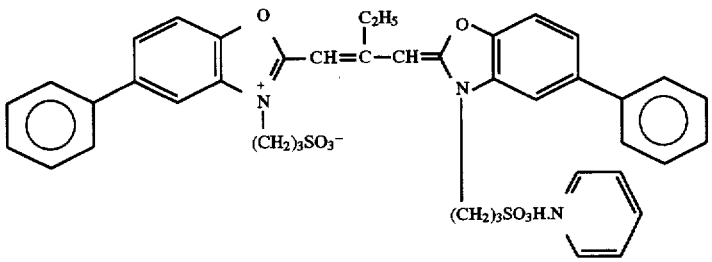

Light-sensitive Silver Halide Emulsion (4) (for Green-Sensitive Emulsion Layer)

Solution (I) and solution (II) shown in Table 8 were concurrently added to an aqueous solution of gelatin well stirred (which was prepared by adding 20 g of gelatin, 0.3 g of potassium bromide, 6 g of sodium chloride and 15 mg of compound (A) to 675 ml of water and maintained at 55° C.) at the same flow rate for 20 minutes. After 10 minutes, solution (III) and solution (IV) shown in Table 8 were further concurrently added thereto at the same flow rate for 20 minutes. Furthermore, 1 minute after termination of addition of solutions (III) and (IV), an aqueous solution of a dye dispersion in gelatin (which contained 2.5 g of gelatin and 250 mg of sensitizing dye (d) in 95 ml of water and was maintained at 45° C.) was collectively added thereto.

After normal washing and salt removal, 20 g of lime-treated ossein gelatin was added to adjust the pH to 6.0 and the pAg to 7.6. Then, sodium thiosulfate, 4-hydroxy-6-methyl- 1,3,3a,7-tetrazaindene and chloroauric acid were added thereto, and chemical sensitization was optimally conducted at 68° C. Thus, 635 g of a monodisperse cubic silver chlorobromide emulsion having a mean grain size of 0.42 μm was obtained.

TABLE 8

| | Solution (I) | Solution (II) | Solution (III) | Solution (IV) |
|---|---|---|---|---|
| $AgNO_3$ | 50.0 g | — | 50.0 g | — |
| $NH_4NO_3$ | 0.25 | — | 0.25 g | — |
| KBr | — | 28.0 g | — | 35.0 g |
| NaCl | — | 3.45 g | — | — |
| | Water to make 200 ml | Water to make 200 ml | Water to make 150 ml | Water to make 150 ml |

Light-sensitive Silver Halide Emulsion (5) (for Blue-Sensitive Emulsion Layer)

Solution (I) and solution (II) shown in Table 9 were concurrently added to an aqueous solution of gelatin well stirred (which was prepared by adding 20 g of gelatin, 0.5 g of potassium bromide, 4 g of sodium chloride and 15 mg of compound (A) to 675 ml of water and maintained at 50° C.) at the same flow rate for 8 minutes. After 10 minutes, solution (III) and solution (IV) shown in Table 9 were further concurrently added thereto at the same flow rate for 32 minutes. Furthermore, 1 minute after termination of addition of solutions (III) and (IV), an aqueous solution of dyes (which contained 220 mg of sensitizing dye (e) and 110 mg of sensitizing dye (f) in 95 ml of water and 5 ml of methanol and was maintained at 45° C.) was collectively added thereto.

After normal washing and salt removal, 22 g of lime-treated ossein gelatin was added to adjust the pH to 6.0 and the pAg to 7.8. Then, sodium thiosulfate and 4-hydroxy-6-methyl-1,3,3a,7-tetrazaindene were added thereto, and chemical sensitization was optimally conducted at 68° C. Thus, 635 g of a monodisperse cubic silver chlorobromide emulsion having a mean grain size of 0.30 μm was obtained.

TABLE 9

| | Solution (I) | Solution (II) | Solution (III) | Solution (IV) |
|---|---|---|---|---|
| $AgNO_3$ | 20.0 g | — | 80.0 g | — |
| $NH_4NO_3$ | 0.10 g | — | 0.40 g | — |
| KBr | — | 9.8 g | — | 44.8 g |
| NaCl | — | 2.60 g | — | 5.52 g |
| | Water to make 80 ml | Water to make 80 ml | Water to make 240 m | Water to make 240 ml |

Sensitizing Dye (e):

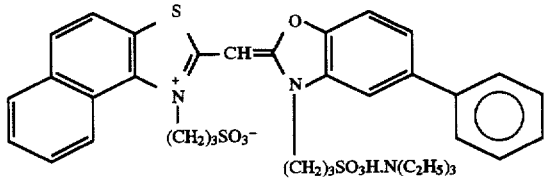

Sensitizing Dye (f):

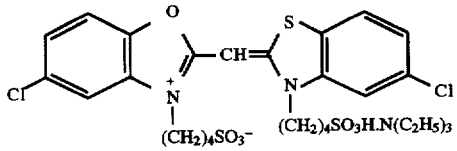

Light-sensitive Silver Halide Emulsion (6) (for Blue-Sensitive Emulsion Layer)

Solution (I) and solution (II) shown in Table 10 were concurrently added to an aqueous solution of gelatin well stirred (which was prepared by adding 20 g of gelatin, 0.3 g of potassium bromide, 9 g of sodium chloride and 15 mg of compound (A) to 675 ml of water and maintained at 65° C.) at the same flow rate for 10 minutes. After 10 minutes, solution (III) and solution (IV) shown in Table 10 were further concurrently added thereto at the same flow rate for 30 minutes. Furthermore, 1 minute after termination of addition of solutions (III) and (IV), an aqueous solution of dyes (which contained 150 mg of sensitizing dye (e) and 75 mg of sensitizing dye (f) in 66 ml of water and 4 ml of methanol and was maintained at 60° C.) was collectively added thereto.

After normal washing and salt removal, 22 g of lime-treated ossein gelatin was added to adjust the pH to 6.0 and the pAg to 7.8. Then, sodium thiosulfate and 4-hydroxy-6-methyl-1,3,3a,7-tetrazaindene were added thereto, and chemical sensitization was optimally conducted at 68° C. Thus, 635 g of a monodisperse cubic silver chlorobromide emulsion having a mean grain size of 0.55 μm was obtained.

TABLE 10

| | Solution (I) | Solution (II) | Solution (III) | Solution (IV) |
|---|---|---|---|---|
| $AgNO_3$ | 25.0 g | — | 75.0 g | — |
| $NH_4NO_3$ | 0.13 g | — | 0.37 g | — |
| KBr | — | 12.3 g | — | 42.0 g |
| NaCl | — | 2.53 g | — | 5.18 g |
| | Water to make 100 ml | Water to make 100 ml | Water to make 225 ml | Water to make 225 ml |

Using the above, light-sensitive material 201 shown in Table 11 was prepared.

Then, 200 mg/m$^2$ of leuco dye (7) and 580 mg/m$^2$ of color developer (9) of the present invention were added to the fourth layer of light-sensitive material 201 as an emulsified dispersion in the same manner as with Example 1, 4 mg/m$^2$ of leuco dye (22) and 10 mg/m$^2$ of color developer (9) were added to the third layer, and 12 mg/m$^2$ of leuco dye (28) and 28 mg/m$^2$ of color developer (9) were further added to the first layer to prepare light-sensitive material 202.

TABLE 11

CONSTITUTION OF Light-sensitive material 201

| Layer No. | Layer Name | Additive | Amount Coated (mg/m$^2$) |
|---|---|---|---|
| 7th Layer | Protective Layer II | Gelatin | 440 |
| | | Silica (size: 4 μm) | 40 |
| | | Surfacant (3) | 16 |
| | | Dextran | 25 |
| | | Water-Soluble Polymer (1) | 2 |
| | | Surfactant (6) | 35 |
| 6th Layer | Protective Layer I | Gelatin | 224 |
| | | Zinc Hydroxide | 250 |
| | | Reducing Agent (1) | 58 |
| | | High Boiling Solvent (3) | 24 |
| | | Surfactant (2) | 3.6 |
| | | Dextran | 13 |
| | | Water-Soluble Polymer (1) | 1.4 |
| | | Surfactant (4) | 3.9 |
| | | Surfactant (1) | 8.4 |
| 5th Layer | Blue-Sensitive Layer | Light-sensitive Silver Halide Emulsion (5) | 429 (in terms of silver) |
| | | Light sensitive Silver Halide Emulsion (6) | 126 (in terms of silver) |
| | | Yellow Coupler (3) | 505 |
| | | Gelatin | 732 |
| | | Reducing Agent (2) | 305 |
| | | High Boiling Solvent (2) | 202 |
| | | High Boiling Solvent (1) | 152 |
| | | Surfactant (4) | 36 |
| | | Antifoggant (1) | 1.8 |
| | | Water-Soluble Polymer (1) | 2 |
| 4th Layer | Intermediate Layer | Gelatin | 540 |
| | | Reducing Agent (1) | 163 |
| | | High Boiling Solvent (3) | 69 |
| | | Surfactant (1) | 5.3 |
| | | Surfactant (2) | 10 |
| | | Dextran | 37 |
| | | Hardener (1) | 31 |

TABLE 11-continued

CONSTITUTION OF Light-sensitive material 201

| Layer No. | Layer Name | Additive | Amount Coated (mg/m$^2$) |
|---|---|---|---|
| | | Water-Soluble Polymer (1) | 10 |
| | | Surfactant (4) | 10.3 |
| 3rd Layer | Green-Sensitive Layer | Light-sensitive Silver Halide Emulsion (3) | 348 (in terms of silver) |
| | | Light-sensitive Silver Halide Emulsion (4) | 99 (in terms of silver) |
| | | Magenta Coupler (2) | 420 |
| | | Gelatin | 575 |
| | | Reducing Agent (2) | 235 |
| | | High Boiling Solvent (2) | 53 |
| | | High Boiling Solvent (3) | 158 |
| | | Surfactant (4) | 28 |
| | | Antifoggant (2) | 1.5 |
| | | Water-Soluble Polymer (1) | 10 |
| 2nd Layer | Intermediate Layer | Gelatin | 637 |
| | | Zinc Hydroxide | 750 |
| | | Reducing Agent (1) | 163 |
| | | High Boiling Solvent (2) | 69 |
| | | Surfactant (1) | 5.3 |
| | | Surfactant (2) | 10 |
| | | Dextrin | 37 |
| | | Water-Soluble Polymer (1) | 4.0 |
| | | Surfactant (4) | 10.3 |
| 1st Layer | Red-Sensitive Layer | Light-sensitive Silver Halide Emulsion (1) | 237 (in terms of silver) |
| | | Light sensitive Silver Halide Emulsion (2) | 96 (in terms of silver) |
| | | Cyan Coupler (1) | 250 |
| | | Gelatin | 436 |
| | | Reducing Agent (2) | 181 |
| | | High Boiling Solvent (2) | 32 |
| | | High Boiling Solvent (3) | 94 |
| | | Surfactant (4) | 22 |
| | | Surfactant (1) | 1.0 |
| | | Antifoggant (1) | 1.1 |
| | | Water-Soluble Polymer (1) | 15 |

Support: Polyethylene Terephthalate (undercoated with gelatin, size: 100 μm)

Surfactant (6):

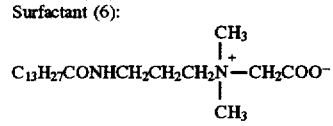

Antifoggant (2):

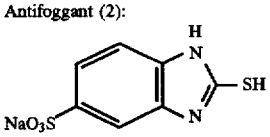

Surface exposure was conducted to light-sensitive materials 201 and 202 through wedges of B, G and R continuously varying in density, and the exposed light-sensitive materials were immersed in water maintained at 40° C. for 2.5 seconds, followed by squeezing with rolls. Immediately, each light-sensitive material was placed on complexing agent sheet R1 used in Example 1 so that a film surface thereof comes into contact with the complexing agent sheet. Then, each light-sensitive material was heated for 17 seconds by use of a heat drum adjusted to such a temperature that the temperature of the water-absorbed film surface was elevated to 80° C., and the light-sensitive material was peeled off from the complexing agent sheet. Together with silver images, negative dye images of Y, M and C were obtained on the light-sensitive materials. Light-sensitive material 201 was big in color impurity of Y and insufficient in sharpness, whereas light-sensitive material 202 was little in color impurity and sufficient in sharpness.

While the invention has been described in detail and with reference to specific embodiments thereof, it will be apparent to one skilled in the art that various changes and modifications can be made therein without departing from the spirit and scope thereof.

What is claimed is:

1. An image formation method comprising imagewise exposing a silver halide light-sensitive material comprising a support having thereon a light-sensitive silver halide, a binder, a slightly water soluble basic metal compound, and a dye composition which is decolorized or discolored on heat development;

contacting the surface of the light-sensitive material with a sheet coated with a binder and a compound which forms a complex with a metal ion constituting the basic metal compound and heating them in the presence of a reducing agent and water after or during the imagewise exposing; and peeling off the sheet to obtain an image on at least one of the light-sensitive material and the sheet, wherein the dye composition comprises an oil-soluble dye formed by a leuco dye and a color developer, wherein the color developer is a metal salt of an organic acid.

2. The method as claimed in claim 1, wherein the sheet comprises a solvent for the silver halide and a physical development nucleus.

3. The method as claimed in claim 1, wherein the silver halide light-sensitive material further comprises a dye-donating compound which forms a dye with an oxidant of the reducing agent by a coupling reaction.

* * * * *